US007336174B1

(12) United States Patent
Maloney

(10) Patent No.: US 7,336,174 B1
(45) Date of Patent: Feb. 26, 2008

(54) OBJECT TRACKING SYSTEM WITH AUTOMATED SYSTEM CONTROL AND USER IDENTIFICATION

(75) Inventor: William C. Maloney, Atlanta, GA (US)

(73) Assignee: Key Control Holding, Inc., Houston, TX (US)

( * ) Notice: Subject to any disclaimer, the term of this patent is extended or adjusted under 35 U.S.C. 154(b) by 867 days.

(21) Appl. No.: 10/216,334

(22) Filed: Aug. 9, 2002

Related U.S. Application Data

(60) Provisional application No. 60/333,463, filed on Nov. 27, 2001, provisional application No. 60/311,182, filed on Aug. 9, 2001.

(51) Int. Cl.
*G08B 13/14* (2006.01)

(52) U.S. Cl. ..... 340/572.1; 340/568.1; 340/825.49

(58) Field of Classification Search ..... 340/572.1, 340/568.1, 568.2, 568.8, 825.49
See application file for complete search history.

(56) References Cited

U.S. PATENT DOCUMENTS

| | | | | |
|---|---|---|---|---|
| 2,971,806 A | | 2/1961 | Andreasen | 312/223 |
| 3,451,043 A | | 6/1969 | Krause | 340/152 |
| 3,648,241 A | | 3/1972 | Naito et al. | 340/147 R |
| 4,209,787 A | | 6/1980 | Freeny, Jr. | 343/112 |
| 4,267,942 A | | 5/1981 | Wick, Jr. et al. | 221/2 |
| 4,519,522 A | | 5/1985 | McElwee | 221/13 |
| 4,549,170 A | | 10/1985 | Serres et al. | 340/568 |
| 4,575,719 A | | 3/1986 | Bertagna et al. | 340/825.35 |
| 4,595,922 A | | 6/1986 | Cobb et al. | 340/825.49 |
| 4,635,053 A | | 1/1987 | Banks et al. | 340/825.31 |
| 4,638,292 A | | 1/1987 | Mochida et al. | 340/63 |
| 4,661,806 A | * | 4/1987 | Peters et al. | 340/568.1 |
| 4,673,915 A | | 6/1987 | Cobb | 340/330 |
| 4,783,655 A | * | 11/1988 | Cobb et al. | 340/825.49 |
| 4,812,985 A | | 3/1989 | Hambrick et al. | 364/478 |
| 4,814,592 A | | 3/1989 | Bradt et al. | 235/381 |
| 4,845,492 A | | 7/1989 | Cobb et al. | 340/825.49 |
| 4,853,692 A | | 8/1989 | Wolk et al. | 340/573 |

(Continued)

FOREIGN PATENT DOCUMENTS

GB 1364535 8/1974

(Continued)

OTHER PUBLICATIONS

Memory-Based Identifier Tag Provides Digital ID- ID Dave Bursky—Electronic Design—Jul. 25, 1992—pp. 153 and 156.

*Primary Examiner*—Benjamin C. Lee
*Assistant Examiner*—Daniel Previl
(74) *Attorney, Agent, or Firm*—Jackson Walker L.L.P.; Mark A. Tidwell, Esq.

(57) ABSTRACT

An enhanced object tracking system for tracking and controlling access to a plurality of objects such as keys is disclosed. The object tracking system implements many improvements including automated user identification using biometric data extracted from the user with a minimum of user interaction, tracking of objects both inside and outside their storage units, the locking of objects within slots of their storage unit to guard against illicit removal and return of keys and to insure random slot rotation, image and visual based inventory verification methodologies, and tracking of objects during times when they are checked out of the system. The result is an intelligent object tracking system with automated control functions and high reliability.

24 Claims, 19 Drawing Sheets

U.S. PATENT DOCUMENTS

| | | | | |
|---|---|---|---|---|
| 4,866,661 | A | 9/1989 | de Prins | 364/900 |
| 4,885,571 | A | 12/1989 | Pauley et al. | |
| 4,889,977 | A | 12/1989 | Haydon | 235/375 |
| 4,896,024 | A | 1/1990 | Morello et al. | |
| 4,918,432 | A | 4/1990 | Pauley et al. | |
| 4,967,906 | A | 11/1990 | Morello et al. | |
| 5,038,023 | A | 8/1991 | Saliga | 235/385 |
| 5,172,829 | A | 12/1992 | Dellicker, Jr. | 221/13 |
| 5,319,544 | A | 6/1994 | Schmerer et al. | 364/403 |
| 5,389,916 | A | 2/1995 | Chen et al. | 340/650 |
| 5,402,104 | A | 3/1995 | LaRosa | 340/539 |
| 5,434,775 | A | 7/1995 | Sims et al. | 364/403 |
| 5,525,969 | A | 6/1996 | LaDue | 340/573 |
| 5,612,683 | A | 3/1997 | Trempala et al. | 340/825.31 |
| 5,619,932 | A | 4/1997 | Efland et al. | 109/24.1 |
| 5,635,693 | A * | 6/1997 | Benson et al. | 340/10.33 |
| 5,689,238 | A | 11/1997 | Cannon, Jr. et al. | 340/568 |
| 5,703,785 | A | 12/1997 | Bluemel et al. | 364/479.14 |
| 5,777,884 | A | 7/1998 | Belka et al. | 364/478.13 |
| 5,801,628 | A | 9/1998 | Maloney | 340/568 |
| 5,805,074 | A * | 9/1998 | Warren et al. | 340/5.54 |
| 5,836,002 | A | 11/1998 | Morstein et al. | |
| 5,905,653 | A | 5/1999 | Higham et al. | |
| 5,957,372 | A | 9/1999 | Dean et al. | |
| 5,961,036 | A | 10/1999 | Michael et al. | |
| 5,963,134 | A | 10/1999 | Bowers et al. | 340/572.1 |
| 5,971,593 | A | 10/1999 | McGrady | 700/233 |
| 6,069,563 | A | 5/2000 | Kadner et al. | |
| 6,073,834 | A | 6/2000 | Michael et al. | |
| 6,075,441 | A | 6/2000 | Maloney | 340/568.1 |
| 6,148,271 | A | 11/2000 | Marinelli | 702/141 |
| 6,195,005 | B1 | 2/2001 | Maloney | 340/568.1 |
| 6,204,764 | B1 | 3/2001 | Maloney | 340/568.1 |
| 6,232,876 | B1 | 5/2001 | Maloney | 340/568.1 |
| 6,292,795 | B1 * | 9/2001 | Peters et al. | 707/3 |
| 6,431,438 | B1 * | 8/2002 | Pires et al. | 235/375 |
| 6,707,381 | B1 | 3/2004 | Maloney | |
| 6,745,366 | B1 | 6/2004 | Roh et al. | |
| 6,788,997 | B1 | 9/2004 | Frederick | |

FOREIGN PATENT DOCUMENTS

| | | |
|---|---|---|
| WO | WO95/04324 | 2/1995 |
| WO | WO95/12858 | 5/1995 |
| WO | WO 00/16280 | 3/2000 |
| WO | WO 00/16281 | 3/2000 |
| WO | WO 00/16282 | 3/2000 |
| WO | WO 00/16284 | 3/2000 |
| WO | WO 00/16564 | 3/2000 |
| WO | WO 01/75811 | 10/2001 |

* cited by examiner

OBJECT TRACKING SYSTEM WITH AUTOMATED SYSTEM CONTROL AND USER IDENTIFICATION

REFERENCE TO RELATED APPLICATIONS

The benefit of the filing dates of U.S. provisional patent applications Ser. Nos. 60/311,182 filed on Aug. 9, 2001 and 60/333,463 filed on Nov. 27, 2001 is hereby claimed.

TECHNICAL FIELD

This invention relates generally to computer controlled object tracking systems, such as key tracking systems, and more specifically to object tracking systems with built-in intelligent automated controls and security functions and with automated user identification and verification.

BACKGROUND

Object tracking systems such as, for example, systems for controlling access to and tracking keys in an automotive dealership, have been available for some time. Among the most innovative of such systems are the object tracking systems and methodologies disclosed in various patents and patent applications of the present inventor. These include U.S. Pat. Nos. 5,801,628; 6,075,441, 6,317,044; 6,195,005; 6,204,764; 6,407,665; 6,232,876; 6,392,543; 6,424,260; and 6,262,664 as well as pending U.S. patent application Ser. No. 10/133,130. The disclosures of all of these patents and patent applications are hereby incorporated by reference. Together they provide much of the detailed background material and detailed discussions of various configurations of hardware and software that underlie the inventions disclosed and claimed in the present disclosure. Accordingly, to the extent that such details are included in these incorporated references, they need not and will not be discussed extensively in the present disclosure.

While the object tracking system disclosed in the above patents and applications have been very successful, particularly when applied to the tracking of and the control of access to keys in an automotive dealership, they also can be somewhat less than completely satisfactory in some situations and environments. For example, these systems generally require a level of active participation by the user when checking objects in and out. A user, for instance, typically is required to identify himself by typing or otherwise entering a user name and to verify his identity by, for example, entering a secret password, placing a finger on a fingerprint scanner, or touching an ID badge or fob to a reader, before the system will allow access to objects secured therein. In some object tracking scenarios, this level of user sophistication and participation is too great, to cumbersome, or otherwise undesirable. In addition, it is less secure that it might be because a user may divulge his user name and password to another user or to unauthorized personnel, who may then access objects in the system using the falsely acquired credentials. A need exists, therefore, for an object tracking system that positively identifies each user with a minimum of user interaction and that prevents unauthorized access with stolen or improper credentials.

Prior object tracking systems also include other areas of potential weakness or security lapses. For instance, in systems for tracking keys, the key tags to which keys are attached generally have not been positively locked in their individual slots, so that a user can remove any key from the system, even keys to which he or she may not have authorized access. In other words, prior systems do not force the user to remove only the key that is requested or authorized. Prior systems also do not insure that the user returns the same key that was initially checked out by that user. Further, a significant measure of security is provided in prior systems because the keys and their key tags are allowed to be returned to any random slot within a bank of drawers, each with scores of slots. Since all the keys look similar, it is extremely difficult with such random slot assignment for a user to locate and extract a particular key with the intent, for instance, of stealing a vehicle, without properly logging into the system and thereby creating an audit trail. However, this security feature can be defeated by a clever user who repeatedly returns the subject key to the same slot within the system so that the physical location of the key is known without logging into the system and requesting the key. A need exists for an improved object tracking system and methodology that is configured and programmed to eliminate this and similar possibilities.

Other and related enhancements to existing object tracking systems also are needed. For example, visual inspection, either personal inspection or inspection through automated imaging techniques, of the condition of inventory in the system is desirable for detecting tampering with or removal of keys or other objects themselves while leaving their ID tags intact. Assignment of and controlled access to particular objects by particular users also is desirable in many scenarios where a user may be authorized to have access only to certain objects and not others or where a user may need access to different objects at different times or access only during certain times (during his or her shift for example). In some cases, objects should not be removed from a designated area and it is therefore desirable for an object tracking system to insure that removal from the area does not occur. In related scenarios, it may be desirable to track the movement of objects within a particular building or other larger area during the times when the object is checked out of the system by a user.

It is to the provision of an enhanced and improved object tracking system that addresses the above and other needs and shortcomings of prior art systems that the present invention is primarily directed.

SUMMARY OF THE INVENTION

Briefly described, the present invention, in a preferred embodiment thereof, comprises an enhanced object tracking system for controlling access to and tracking a large number of objects such as keys. The system of the invention will, in fact, for the sake of clarity and brevity, be described herein primarily in terms of a system for tracking a large number of keys and particularly keys to vehicles at an automotive dealership. Where the tracking of other types of objects is appropriate, the system will be discussed in terms of tracking such objects. It will be understood by those of skill in the art, however, that, regardless of the particular context in which the system of this invention is discussed herein, it is applicable to the controlled access to and tracking of a wide variety of objects to which users need periodic access in the course of their duties. Such objects include, for example, jewelry, narcotics, test equipment, electronic access cards, and other objects that are subject to being checked out to authorized users for limited periods of time.

The key tracking system of the preferred embodiment includes a computer based controller that is coupled to and controls the various components of the system as described below. A plurality of key tags each is attached or attachable to one or more keys to be tracked. Each key tag is provided with at least one radio frequency identification (RFID) chip and associated antenna, either attached to the body of the key tag or attached, in one embodiment, to a tamper proof key ring or tether, which also secures the keys to the key tag. In another embodiment, two RFID chips are provided, one attached to the body of each key tag and another to the tamper proof key tether. Each RFID chip stores a unique identification code associated with and identifying its key tag and thus the keys attached thereto and is capable of transmitting its code via its antenna when appropriately polled. The transmitted identification code is receivable by an RFID reader coupled to the computer controller and the controller is programmed to receive and read identification codes from the reader. The incorporated U.S. Pat. No. 6,204,764 discloses and describes such RFID chips (sometimes referred to as RFID tags) and readers in some detail.

An enclosure or storage unit in the form of at least one cabinet with a lockable drawer is provided for receiving and storing key tags and their keys at a central location. Alternate types of enclosures such as, for instance, a wall mounted cabinet with hinged door, also may be used. In the preferred embodiment, however, the drawer is provided with an internal panel having an array of slots, each for receiving and storing a key tag and the keys attached thereto when they are checked into the system. A locking pin assembly is associated with each slot below the panel and each key tag is formed with a corresponding hole or groove that aligns with the locking pin of a slot when the key tag is fully inserted in the slot. Each locking pin is retractable by means of a solenoid that is coupled to and controlled by the computer controller. The locking pins can be independently and selectively retracted and extended by the controller as needed either to lock a key tag in place within the corresponding slot or to prevent a key tag from being inserted into an inappropriate slot. A presence detector also is associated with each slot in one embodiment to detect when a key tag is fully inserted in the slot so that the locking pin can be engaged.

An internal global RFID reader and associated antenna is disposed in the storage unit and is positioned to receive radio frequency transmissions from any RFID chips located within the storage unit. The global RFID reader is coupled to, communicates with, and is controlled by the computer controller of the system for transmitting identification codes received by the RFID reader to the computer controller. Techniques for polling and receiving transmissions from large numbers of RFID chips while avoiding data collisions and cross talk are known and generally available from manufacturers of RFID chips and readers. In general, the global RFID reader may be used by the controller to determine which key tags and associated keys are present within the storage unit at any time.

A biometric identification unit is coupled to the computer controller for identifying users who request access to the system and the keys stored therein. The biometric identification unit may include one or more passive identification sensors such as, for example, a fingerprint scanner, a facial feature scanner, a retinal scanner, or other type of reader for reading biometric information that is unique to each user. The controller receives the information from the biometric sensor and is programmed with appropriate pattern recognition algorithms and stored data bases to identify positively each user requesting access to the system or, alternatively, to recognize when an unauthorized user requests access. An external digital camera also is provided in one embodiment for generating a visual record of each request for access, which can be stored for future use or transmitted to security personnel in the event of a suspicious request for access.

In one preferred embodiment, the system is provided with an internal digital camera and light source within the storage unit. The camera is coupled to and communicates with the controller to transmit images of the inventory (keys and key tags) within the storage unit at any time upon command. These images can be taken, for instance, immediately after a check in or periodically during inactive periods to provide visual verification that key tags and their keys have not been illicitly tampered with by, for example, the cutting of a key or keys from their tag prior to placing the tag in a slot of the storage drawer. In this same vein, the storage unit may be provided with a clear wall made of glass, Plexiglas, Lexan, or other clear material to provide for personal visual inspection of the inventory within the storage unit by security personnel. If a clear wall is provided, security measures in the form, for instance, of an embedded array of conducting threads also may be provided in the wall to detect an attempted break in by a would-be thief who breaks the glass or other material of the clear wall.

A separate external RFID reader is provided in one embodiment and this reader is configured for long range detection of the radio frequency transmissions of RFID chips associated with the key tags. This external reader is useful in scenarios where objects checked out of the system are to stay in the vicinity of the storage unit. In these scenarios, the external RFID reader continuously receives identification codes from RFID chips within its range and transmits these codes to the computer controller. If a checked out object is moved out of the authorized vicinity, it will move out of range of the external RFID sensor and its signal will be lost. This is an indication to the controller that the object has been illicitly moved from the vicinity and appropriate alarms can be sounded and security personnel alerted.

The basic system described briefly above provides for a number of enhanced security features, all of which will be discussed in more detail below. In summary, these features includes the ability to reduce significantly or eliminate completely the level of active participation required from a user during transactions with the system. Rather than being required to enter a user name and PIN number, for instance, a user is automatically identified and verified from his or her biometric data, such as a fingerprint, facial features, or retinal scan. Such means of identification not only reduces user interaction, it also is more secure because it eliminates fraudulent use of the credentials of another to gain illicit access to the system. The locking pin array of the system facilitates intelligent controlled access to tracked objects through a workload/scheduling function. This function allows a supervisor, for example, to designate specific objects to which each user has access and/or to designate times of day (e.g. during each users shift) during which each user is authorized to have access. The system insures that users have access only to objects they should have access to and only at the times when they should have access.

Other functions facilitated by the system include the ability to force random object rotation among slots of the storage unit by designating to users specific slots to which key tags should be returned upon check in. The key tags are forced to be inserted only in those slots by appropriately manipulating the locking pins of the slots so that only the designated slot is in condition to receive a key tag. Visual confirmation of the condition of keys and their key tags inside the storage unit is made possible by the internal digital camera with wide angle lens and by the clear wall of the unit, which allows for personal visual inspection. Providing two RFID chips on each key tag, one on the key tag and one on a tamper proof tether (the incorporated U.S. Pat. No. 6,262,664 discusses such tamper proof tethers in detail), provides further security against the malicious removal of keys from their key tags and also provides for tracking checked out keys within a specified area to insure that they are not removed from the area. The system also may be coupled to a zonal transition detection system, which may include triangulation receivers, to track the movement of checked out keys or other objects throughout a building, car lot, or other larger area.

The forgoing and additional significant enhancements and improvements are provided by the system and methodology of the present invention. These and other features, objects, and advantages of the invention will be understood more fully upon review of the detailed description set forth below, when taken in conjunction with the accompanying drawing figures, which are briefly described as follows.

DETAILED DESCRIPTION OF THE PREFERRED EMBODIMENTS

Figure 1:
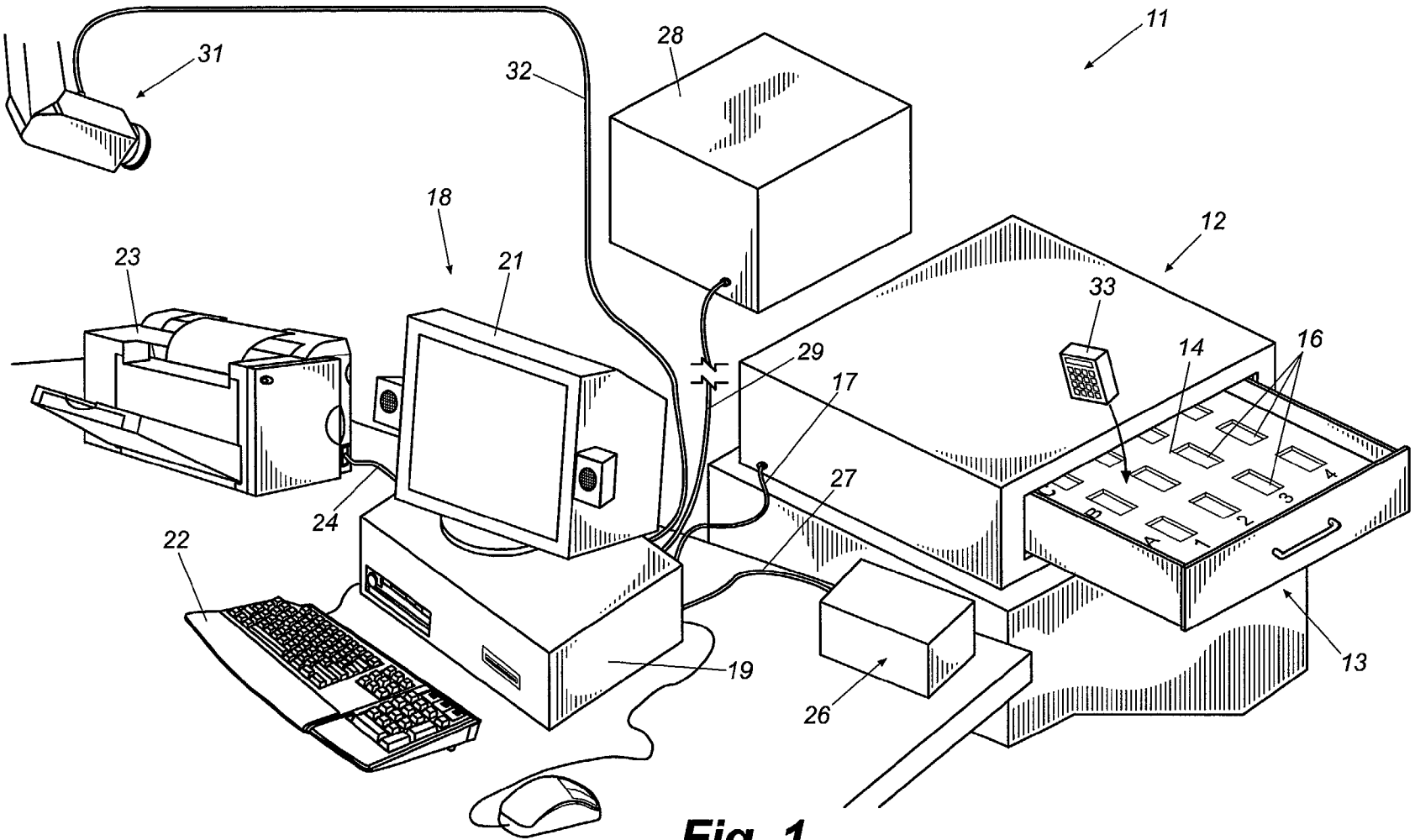
FIG. 1 is a perspective somewhat schematic view of an object control and tracking system that embodies principles of the invention on one preferred form.
Figure 2:
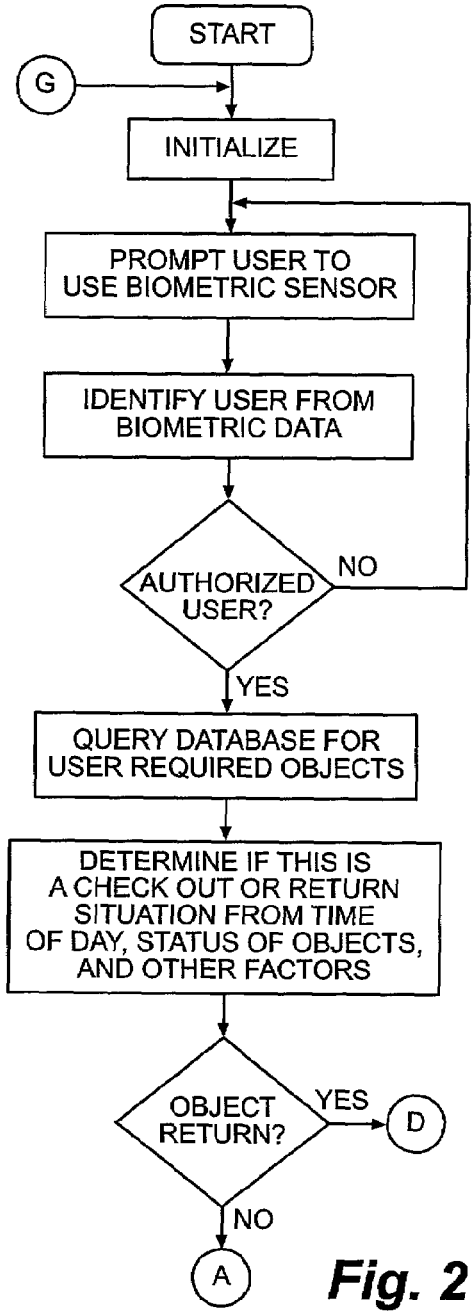
FIGS. 2 through 6 together comprise a functional flow chart illustrative of an object control and tracking methodology that embodies principles of the invention.
Figure 3:
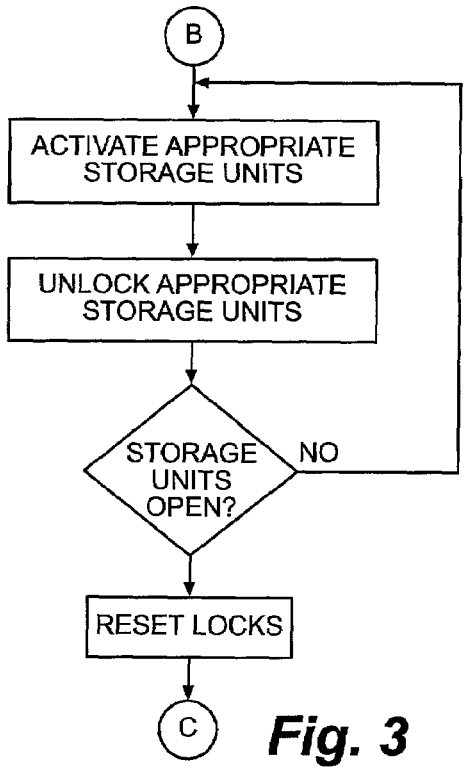
Figure 4:
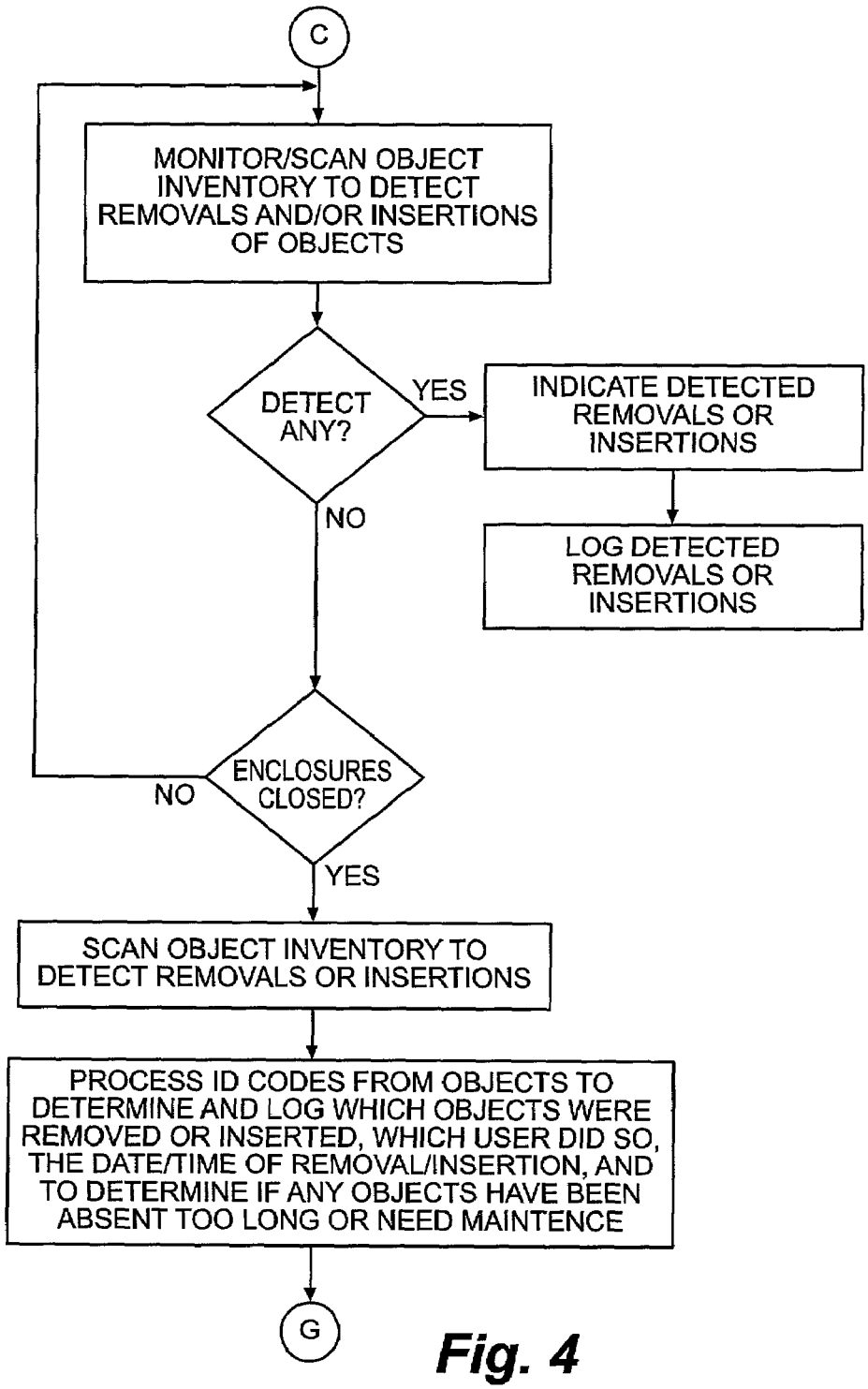
Figure 5:
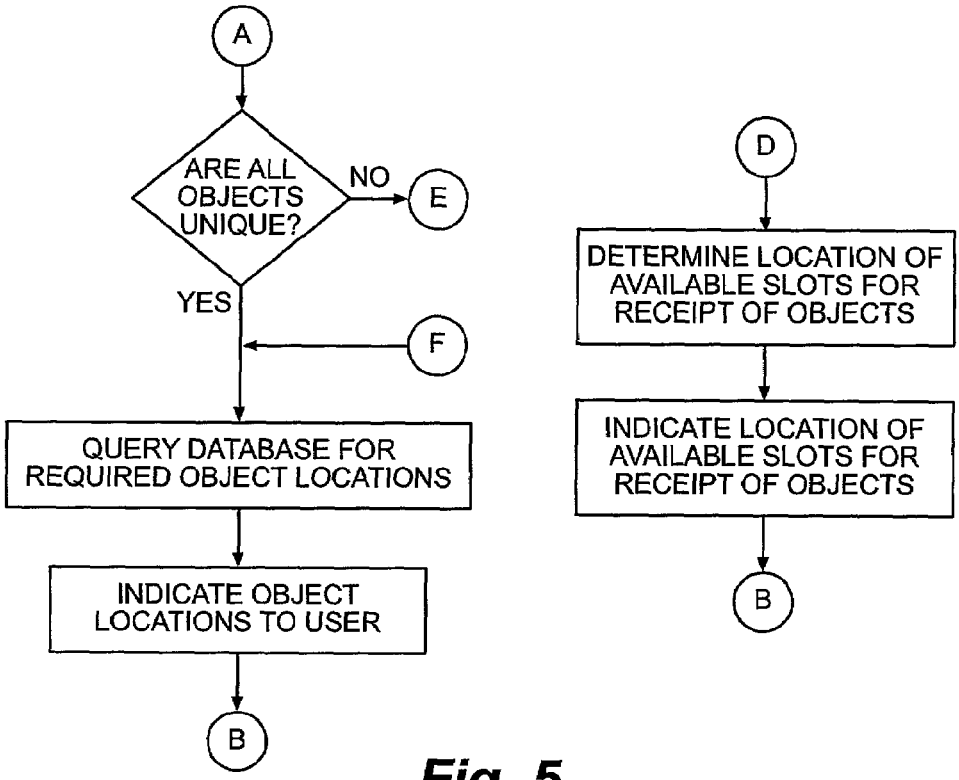
Figure 6:
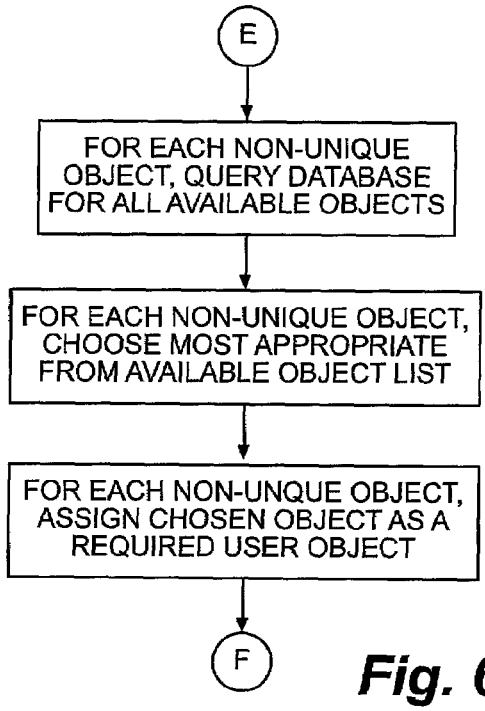

Referring now in more detail to the drawing figures, wherein like reference numbers indicate, where appropriate, like parts throughout the several views, FIG. 1 illustrates an object tracking and control system 11 that embodies principles of the invention in a preferred form. The system 11 comprises a storage unit 12 that, in this embodiment, takes the form of a cabinet housing an openable drawer 13. The drawer 13 has an internal panel 14 formed with an array of slots or receptacles 13 sized and shaped to receive trackable objects 33, each having at least one unique readable identification code contained within a contact memory button, RFID chip or otherwise. The trackable objects 33 may be key tags attached to keys, object enclosures that contain objects to be tracked, or otherwise, as described in the incorporated patents and patent applications. The storage unit contains a sensor or sensors (not visible) for detecting the identification codes of trackable objects within the drawer at any time.

A controller 18 in the form of a personal computer 19, monitor 21, and keyboard 22 is provided for monitoring and controlling the various elements of the system, as described in more detail in the incorporated patents and patent applications. The storage unit and its internal sensor or sensors are coupled to the controller 18 by means of an appropriate communications link 17. A printer 23 is connected to the controller 18 by a communications link 24 for printing various status and other reports that may be generated by the controller from time to time.

A biometric identification unit 26 is coupled to the controller by a communications link 26 for positively identifying users during a transaction. The biometric identification unit may take the form of a fingerprint reader, a facial feature scanner, a retinal scanner, or other type of scanner, or combinations thereof, for scanning a selected unique biometric feature of users who request access to the system. The controller is programmed with appropriate pattern recognition software and user feature databases such that, upon receiving a scanned biometric feature of a user, the user can be positively identified by comparing the scanned feature to stored features of authorized system users. It will thus be seen that, by implementing the biometric identification unit, the level of user interaction with the system is reduced significantly or eliminated because the user no longer needs to enter information (user name, PIN number verification, etc.) into the system manually. The biometric information provided by the biometric identification unit 26 is gathered without manual user input and used by the controller to identify each user positively without the need for a separate verification step via, for instance, entry of a PIN number.

Use of biometric data also eliminates fraud that is possible with prior systems because a user cannot provide his user name and PIN number to another individual who can use the information to gain unauthorized access to the system. To provide further security, an external security camera 31, which may be a small digital camera, is provided to record a digital image of users who request access to the system. The security camera 31 is coupled to the controller through a communications link 32 and is controlled by the controller to snap an image of users requesting access. These images can be stored for future review, or can be transmitted to security personnel, particularly in the event of an attempted access by unauthorized persons. The camera 31 also may be used in conjunction with the biometric identification unit 26 to produce, for example, a digital image of a user's facial features for identification using facial feature recognition software in the controller.

A remote monitoring and workload scheduling system 28 is provided and is coupled to the control computer by means of a remote communications link 29. The remote link 29 may, for example, be a network communications link, a radio frequency link, or otherwise. The remote monitoring and workload scheduling system 28 includes a remote computer and appropriate software for monitoring the status of the object control system from a remote location. Also, and significantly, the remote monitoring and workload scheduling system 28 may be used by work supervisors, for example, to schedule specific access criteria for each authorized user of the system, as discussed in more detail below. For instance, a supervisor, using the remote monitoring and workload scheduling system 28, may designate to the controller 18 specific objects that each user should have access to and objects to which each user should not have access. Further, the supervisor may specify specific time periods during which each user is authorized to access the system or to access particular objects stored in the system. These time periods may correspond, for example, to each user's scheduled shift to ensure that users are not able to access the system during times when they are not scheduled to work. Other features and functions of the remote monitoring and workload scheduling system are described and discussed in more detail below.

With the hardware configuration of the system 11 in mind, a discussion of the various functions and methodologies of the invention will be described, with general reference to the flowchart of FIGS. 2 through 6. This flowchart illustrates the preferred steps to be followed during system usage. The system generally operates in two modes; object check-in and object check-out. Both modes share common steps as indicated in the flow chart. For clarity, each mode will be described in some detail, followed by a description of the workload scheduling methodology of the invention.

Object Check-In (Return)

When a user desires to return an object, such as a key, that has previously been checked out, he or she approaches the system, which, after initialization, prompts the user via the monitor to use the biometric identification unit to identify the user to the system. As mentioned above, the biometric identification unit can include sensors as simple as a fingerprint scanner or as complex as a facial feature scanner or retinal eye scanner. With biometric data extracted from the user, the controller identifies the user positively from his or her biometric data by comparison with a stored biometric identification database containing biometric feature models of each authorized user. If the user is not identified as an authorized user, the controller will not allow the user access to the system inventory. Similarly, if the user is authorized but, for example, is attempting access during an unauthorized time period such as when the user is not scheduled for work, as determined by the workload scheduling function below, or the system is locked down, then access can be denied. In either case, appropriate alarms may be generated and security personnel notified of the attempted unauthorized access as desired.

If the user is an authorized user during an authorized time period, the controller queries a data base of objects assigned to and required by this user. Pairing of specific objects to specific users also is accomplished through the workload scheduling function by supervisors or others in charge of access to objects (for example, in the case of a pool of truck drivers, each driver may be assigned access only to the keys to the particular vehicle to be driven by that driver during the current shift). If the controller determines that the assigned objects are already checked out by the user, then it may be safely assumed that this access by the user is for the purpose of object return (check-in). Other narrowing factors may be used if applicable such as, if the current time is consistent with the start of the user's shift, in which case object check-out is most likely the appropriate function required by the user. Upon determining that object check-in (return) is the appropriate function for this user at this time, the controller then determines the appropriate slots or receptacles within the storage unit for receiving the objects to be returned by the user. For example, large objects may require special large receptacles or electronic test equipment checked out by the user, for example, may require special receptacles to enable recharging or uploading/downloading of data. When the appropriate locations for the return of objects being checked-in by the user are determined, the controller indicates the location(s) of available slots to the user.

The controller then activates the appropriate storage units that contain the available slots. This may entail powering up the storage unit or its internal sensors and other initialization activities. The controller then unlocks the appropriate storage unit. If the storage unit doesn't open, the controller will retry the activation and unlock procedures for the storage unit that failed to open the first time. After the appropriate storage units are unlocked and opened, the controller resets the locks on the now unlocked storage units to insure that the units will lock when they are next closed.

The controller now monitors the internal sensors of open storage units for any object removals and/or insertions and logs any such detected events. During this process, all activity is monitored and logged. For example, if a user removes an object and then replaces it, both the removal and the replacement is logged by the controller. If the user is not authorized for this item, alarms can be generated and appropriate personnel or systems notified through the remote communications link. If the user removes a wrong but authorized object, the controller may alert the user to the potential mistake to allow the user to rectify the situation. The alert can be an audible sound and, for particularly sensitive objects, the alert may be transmitted to remote security personnel. The remote security personnel also have access to an image of the user by means of the digital camera of the system for visual identification of the user and the session.

When the user correctly returns the previously checked-out objects to the proper designated slots, the drawers of the opened storage units are closed. At this time, the controller performs an inventory scan through the internal sensors within the storage units to detect new objects that have been returned, as well as objects that may have been taken from the storage units. Any removed objects are logged as checked out by the user and inserted objects are logged as having been returned by the user. The controller also may log the locations of the returned and removed objects if the storage unit is equipped to determine location. If an unauthorized object is mistakenly removed or object removal is unauthorized, appropriate alarms and alerts are generated and transmitted to security personnel.

Where the objects being checked out and returned are electronic equipment such as, for example, test equipment checked out and in by repair or maintenance personnel, then the controller may conduct a test to determine if the returned equipment is faulty (for example, the equipment may not properly initiate a data download), schedule appropriate maintenance (such as connector cleaning, battery change, etc.), and mark the object as unavailable for further checkout. Also, the controller can schedule routine maintenance of such electronic equipment according to predetermined maintenance schedules (for example, after a total number of usage hours, batteries need to be replaced, etc.) and mark the object as unavailable for further checkout. The controller also may generate reports of the status and maintenance schedules for equipment in the storage unit and provide other valuable information based upon generated logs of equipment usage. This ends the object return procedure, and the system returns to its user login status.

Object Check-Out

After initialization, the controller prompts the user to login using the biometric identification unit. The controller positively identifies the user from the sensed biometric identification data as described above. If the user is not recognized as an authorized user, the controller will not allow access to the system and may generate appropriate alarms and alerts. If the user is attempting access to the system during an unauthorized time period such as during a time when he or she is not scheduled for work, the controller may be programmed not to allow the user access to system inventory and, again, may generate appropriate alarms and alerts.

If the user is authorized and the time is appropriate, the controller queries its internal data base to determine which objects in the system are assigned to and required by this user, based upon input from a supervisor using the workload scheduling system. If these objects currently are in inventory, as determined by a scan of the storage units, the controller assumes that the user is requesting check-out of objects. As with check-in, other narrowing factors can be applied such as, if the current time is consistent with the scheduled start of this user's shift.

Objects assigned to each user may be unique objects, such as a set of keys, or they may be non-unique objects such as a piece of test equipment, data scanner, or the like, of which there may be several identical units stored in the system. For each non-unique object, the controller queries its internal data base for all available objects of the assigned type and determines the current condition (e.g. batter life, etc.) of each object. The controller then chooses the most appropriate object from the list of available objects. In making this choice, the controller may consider object attributes such as the charge status for electronic devices, number of uses since the device's last maintenance (to even out device usage), and other attributes. Alternately, the user may be assigned a particular object and the controller can select another similar object when the assigned object is logged as defective, needing service, or otherwise not available. The controller then assigns the chosen non-unique object or objects as appropriate to be checked-out by this user. Once all appropriate objects are uniquely assigned to this user, the controller continues with the check-out procedure.

The controller next queries its internal object database to determine the locations within the storage unit or units of the object or objects assigned to be checked out by this user. The appropriate storage unit is then activated with appropriate powering up procedures as required and is unlocked. If the storage unit fails to open, the controller retries the activation and unlock procedures. After the appropriate storage unit or units are opened, the controller resets their locking mechanisms to insure that they will lock successfully when next closed.

The controller now monitors the open storage units for any object removals and/or insertions. If any removals or insertions are detected, the controller logs these events and all such events are logged. For example, if the user removes an object and then replaces it, both the removal and the replacement are logged. If the user is not authorized for access to this object, appropriate alarms and alerts can be generated and security personnel notified if required. If the user removes a wrong but authorized item the controller alerts the user to this potential mistake to allow the user to rectify the situation. For particularly sensitive objects, the alert also can be transmitted to appropriate security personnel, who have access to the transaction visually through the security camera of the system. Once the user removes (checks out) items from the storage unit, the unit is closed.

Upon closure of the storage unit or units by the user, the controller performs an object inventory scan using the internal sensors within the storage units and any removed items are logged as checked-out by the user, and any inserted objects are logged as returned or checked-in by the user. The controller also may log the locations (slots) where the objects are located if the system is equipped to determine individual slot location. The controller now can compare the information from its inventory scan to detect abnormalities such as, for instance, if any of the objects have been absent from the system too long, etc. As discussed above, if an authorized object is mistakenly removed or object removal is unauthorized, appropriate alarms and alerts can be generated and transmitted to appropriate security personnel. This ends the object check-out procedures and the system returns to its user log-in state.

Workload Scheduling and Supervisor Functions

The forgoing discussions of check-in and check-out methodologies refer to assigned objects for each user. These objects assignments are determined and inputted either at the controller or the remote workload scheduling system by a supervisor or another person responsible for object assignment and maintenance. The object assignments can be changed as frequently as required. For example, a delivery person might be assigned to the keys for a different delivery truck each day because of changing routs, package sizes, quantities, and the like. In another example, objects, such as electronic test equipment, tools, and the like, assigned to technicians or maintenance personnel may change several time during a shift, potentially once for each new maintenance project or assignment. The supervisor also can input each user's work schedule so that the system can detect an abnormality if a user attempts to access the system at a time other than when he or she is scheduled to be working. This work schedule can be used for other purposes by the controller to limit required user interaction during check-in and check-out. For instance, if the controller determines that the current time is the beginning of a particular user's shift, an assumption may be made that this user wishes to check-out objects and this assumption will be correct most every time. Conversely, if the time corresponds to the end of a user's shift, it may safely be assumed that this user desires to check objects in to the system. In either case, the correct mode of operation is selected without any interaction or input from the user.

The significant reduction in required user interaction with the intelligent system of this invention is an important advance over prior object tracking and control systems. Clearly, however, the level of automation in this regard can be scaled back as appropriate. For example, if an object being checked in is broken or defective, the user can select an appropriate screen and identify the object as needing repair, whereupon the controller schedules the object for appropriate maintenance and removes it from the available object list. Alternatively, if a higher level of security is required at login, additional information such as a PIN number can be required from users and/or biometric scanners of different types can be used in tandem to enhance the positive identification of the user. These and other additions, deletions, and enhancements will be apparent to those of skill in the art, but all are and should be considered to be within the scope of the present invention.

Figure 7:
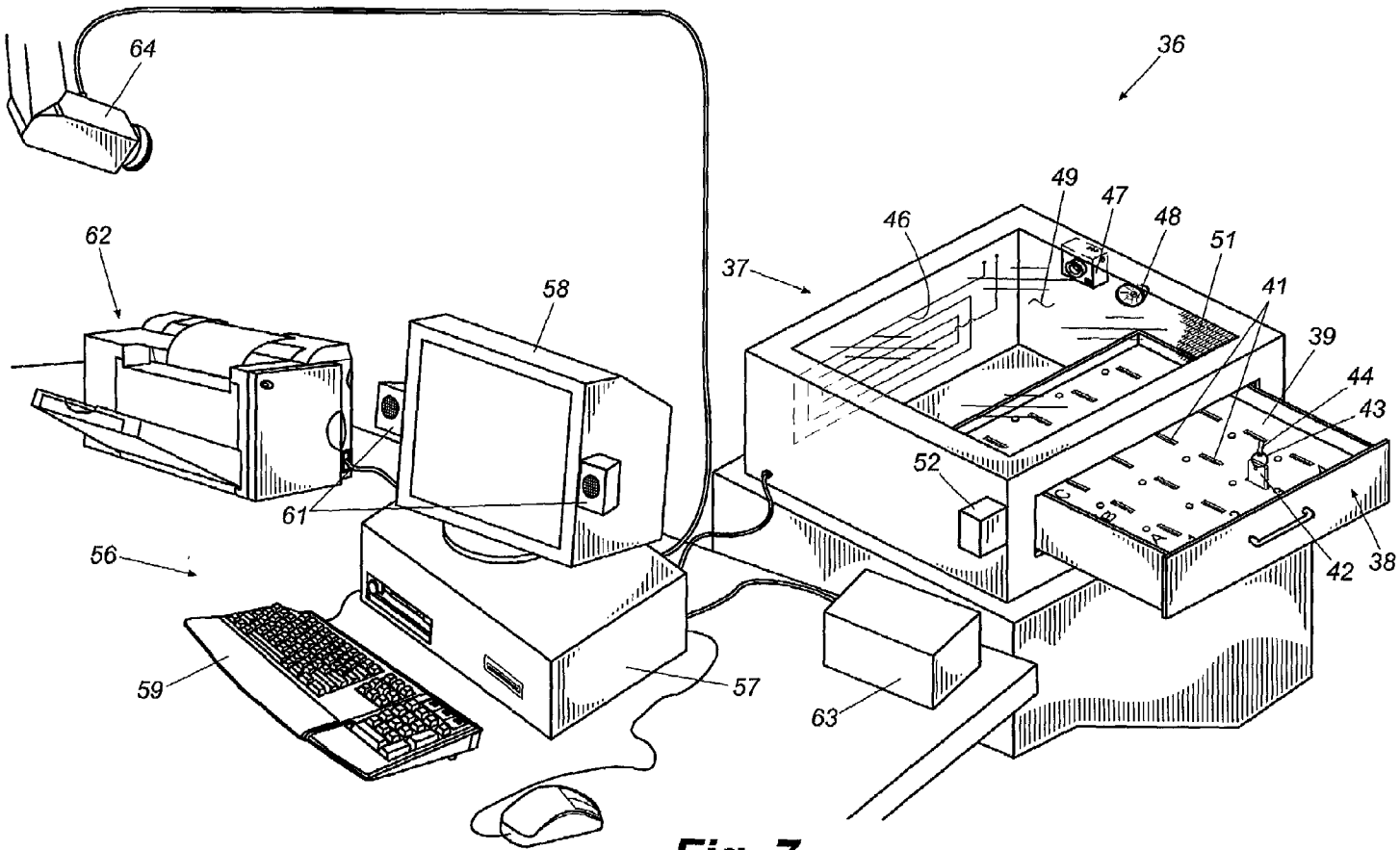
FIG. 7 is a perspective partially schematic view of an object control and tracking system that embodies principles of the invention in an alternate form.

FIG. 7 illustrates an alternate embodiment of an object tracking system according to the present invention. Many of the components in FIG. 7 are the same as those in FIG. 1. The system 36 includes at least one storage unit 37 having a lockable and openable drawer 38. A panel 39 is disposed in the drawer and is provided with an array of receptacles or slots 41 configured to receive trackable objects, which, in the preferred embodiment comprise electronic key tags 42. Each key tag 42 preferably is provided with a tamper proof tether 43 for attaching keys to the key tag and an RFID fob 44 containing an RFID chip and associated antenna is attached to the tamper proof tether 43 of each key tag. A global RFID reader 46 is disposed inside the storage unit for reading the unique identification codes of RFID chips in the storage unit, and thereby to identify which keys are in the storage unit at any given time. In this embodiment, a clear panel 49 is provided in the top of the storage unit to provide for manual visual inspection of inventory within the storage unit. A grid of conducting threads 51 are embedded in the clear panel and are monitored to enhance security by detecting an attempted illicit entry into the storage unit by breaking the glass or clear plastic. An internal digital camera 47 having a wide angle lens and an associated light source 48 are provided in the storage unit for imaging the inventory of the storage unit at desired times.

A computer controller 56 is provided and includes a computer 57 a monitor 58, a keyboard 59, and audio speakers 61. The RFID reader 46 in the storage unit as well as the internal digital camera 47 and light source 48 are coupled to the computer controller for transmitting information and commands to and from these devices and the controller. A printer 62 is coupled to the controller for printing reports and the like and, as with the embodiment of FIG. 1, a biometric identification unit 63 is provided for scanning one or more selected biometric features of users requesting access to the system. An external digital camera also is provided for providing digital images or movies of transactions between users and the system. These images may be used by security personnel in the event of a suspicious attempted access to identify the perpetrator. Finally, an external, preferably long range, RFID reader is provided and is coupled to the computer controller via an appropriate communications link for transferring identification numbers read from RFID chips within the vicinity of the system to the controller.

Figure 8:
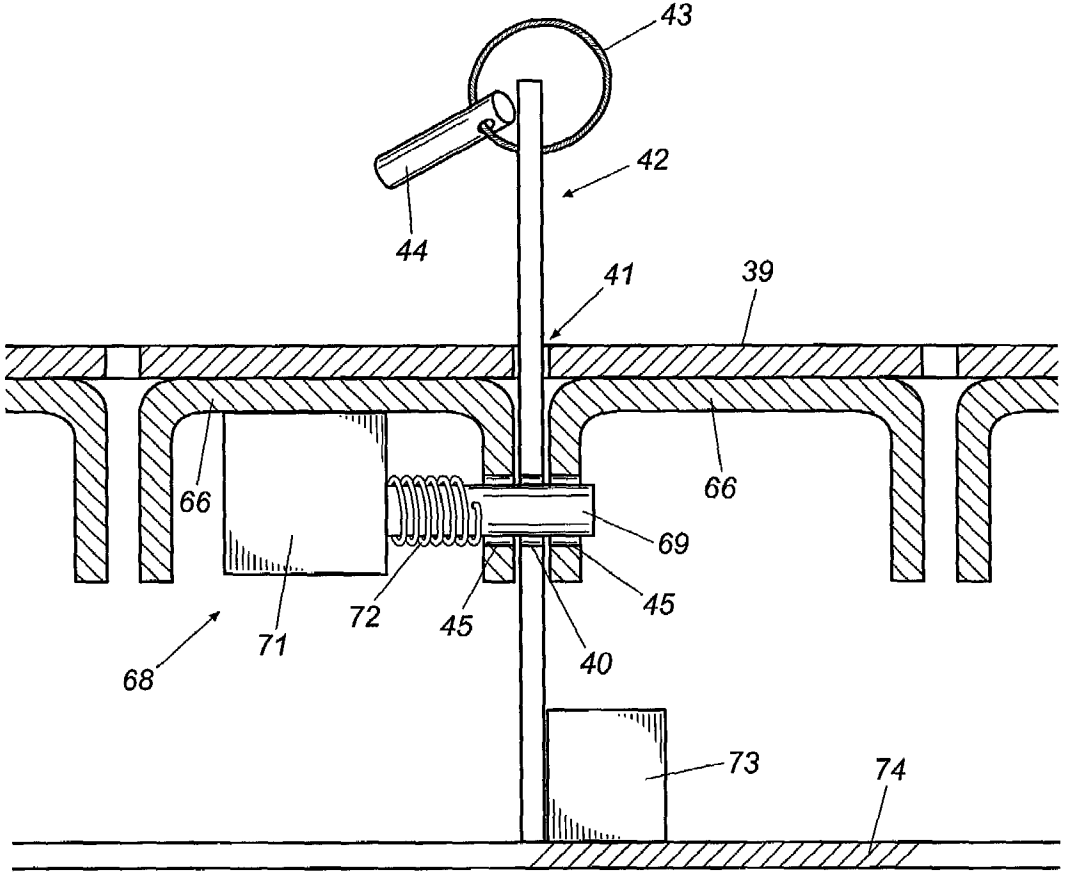
FIG. 8 is a cross sectional view through the drawer of the system shown in FIG. 1 or 7 illustrating insertion of a key tag and one embodiment of a locking pin assembly for locking the tag in place.

FIG. 8 illustrates one embodiment of a key tag retention system within the drawer of the storage unit. A key tag 42 is shown inserted in a slot in the panel 39 of the drawer. Arrays of alignment brackets 66 are mounted to the bottom of the panel to keep key tags properly aligned as they are inserted into slots. Each key tag is provided with a retention hole 40 that aligns with a pair of holes 45 formed in the legs of adjacent brackets. A locking pin assembly 68 is associated with each slot and each locking pin assembly includes a locking pin 69, a solenoid 71, which is coupled to the computer controller, for selectively retracting the locking pin, and a biasing spring 72 for biasing the locking pin to its fully extended position. The locking pin is aligned with the holes 45 in the alignment brackets so that the pin extends through the holes when extended and is retracted out of the holes when the solenoid is activated. A presence detector, which may be an optical, mechanical, or magnetic detector, is associated with each slot and is attached to a backplane (or just the bottom panel of the drawer) for detecting when a key tag is fully inserted into the corresponding slot of the drawer. With this configuration, it will be seen that key tags may be locked in place in their respective slots when the locking pin is extended through the holes 45 in the brackets and through the hole 40 in the key tag, as illustrated in FIG. 8. The locking pin may be retracted at the appropriate time and under appropriate conditions, as described below, to allow the key tag (or selected key tags) to be removed from the slot 41. Further, selected ones of the locking pins can be extended when the slots are empty to prevent a key tag from being inserted into a non-designated slot and to allow it to be inserted only in a designated slot where the locking pin is retracted. In this way, random rotation of key tags among slots can be enforced.

Operation of the system of FIG. 7 will be described within the context of tracking keys, although it will be understood that the same procedures may be applied to the tracking of a wide array of object types other than keys. To gain access to object inventory in the storage unit, an authorized user must first log into the system. This may be done in any of a variety of ways such as, for example, by entering a user name and password, by allowing the biometric identification unit to read biometric information such as a fingerprint, facial features, or a retinal eye scan, or by swiping an identification card with RFID embedded user credentials. One or more of these login procedures may be required depending upon the level of security desired. The external camera records an image of each user who attempts to gain access to the system and this image is communicated to the computer controller. The image may be archived or relayed to appropriate security personnel as required. The camera 64 also can function in conjunction with the biometric identification unit to extract facial features from an image of the user for use by pattern recognition and identification software to identify the user with a minimum of required user interaction with the system. After the user has successfully logged in, the system may enter one of several modes of operation, the two main modes being object return and object check-out.

Object Return

Following successful user login, the controller scans the inventory database to determine which, if any, objects currently are checked out to this user. If any objects are currently checked out, the controller prompts the user the select between "object return" and "object check-out." This section discussed the object return operation, with object check-out being discussed in the following section.

When object return mode is determined, the user places the object to be returned within the read range of the external RFID reader 52. The range of this reader can be preconfigured to be as close as nearly touching the reader or as far as many feet. The external RFID reader prompts and reads the RFID chip attached to the key tag, which contains a unique identification code that uniquely identifies the key tag and, through table lookup, the keys attached thereto. The controller then chooses an appropriate slot from the available empty slots in the storage unit (see flowchart of FIG. 16). In some applications, it is desirable to force certain sets of keys to be returned always to designated slots. For example, it may be desirable to locate certain keys quickly by their location in an emergency such as, for instance, a loss of power. In other applications, it is desirable to force the user to return the key tag and its keys to a random slot upon each return. In these cases, the controller can insure random rotation of key tags by selecting random return locations. If the key tags and their keys all look very similar, this is an effective form of security. The controller and system of this invention can accommodate each of these return scenarios on a key-tag by key-tag basis.

After selecting an appropriate return slot, the controller releases the lock on the storage unit drawer (or on the drawer containing the selected slot in multi-storage unit configurations) to allow the drawer to be opened. The selected slot within the open drawer may be indicated to the user in one or more of a variety of ways. For instance, the coordinates of the selected slot (row and column) may be displayed on the monitor of the controller, an LED adjacent to the selected slot can be lit by the controller, the audio speakers 61 can broadcast the location of the slot audibly, or the controller can use a combination of these indications to identify the proper slot. After indicating the selected slot to the user, the controller then activates the solenoid of the locking pin assembly associated with that slot to retract the locking pin from the slot. This clears the slot of the obstruction caused by the extended locking pin to allow the key tag being returned to be inserted into the slot. The presence detector 74 detects when the key tag is fully inserted into the slot and the controller de-activates the solenoid to allow the locking pin to be extended by the biasing spring 72 back through the slot and through the hole 40 formed in the key tag.

When the key tag is inserted and locked in place within the selected slot, the user is prompted to close the drawer, whereupon the drawer locking mechanism is engaged by the controller to lock the drawer securely shut. The controller then activates the internal global RFID reader 46 to scan and read the identification codes of RFID chips attached to key tags within the storage unit. Comparison of the inventory before and after the access reveals all changes (insertions and/or removals of key tags) within the storage unit. The controller expects to find one new key tag whose identification code matches that of the key tag and keys that the user was to return. If the user intentionally or accidentally returned the wrong key tag, the controller will note the mistake. Depending upon the scenario (which tag was mistakenly returned, security level required, etc.) the controller can decide whether to allow the erroneous return, prompt the user to remove the wrong tag and replace it with the correct tag, or generate appropriate alarms for security personnel. In either event, the controller logs the suspicious return and notifies appropriate security personnel. When the object is returned as described above and the storage unit secured, the object verification procedure is initiated by the controller.

Object Verification

The object verification procedure can be executed by the controller after the storage unit is closed and secured following an object return or check-out, and/or periodically during inactive periods. The internal camera 47 with wide angle lens is activated by the controller to record and transmit to the controller an image of the key tags and keys within the storage unit. The light source 48 is activated during image acquisition to illuminate the inventory being photographed. The resulting image can be archived or relayed to security personnel for inspection. The purpose of the image is to provide an audit trail to insure that the keys are still attached to their key tags and to verify that a user returned the keys attached to the key tag. In other words, acquiring images of the inventory prevents a devious user from removing keys from their key tag and inserting just the tag back into the drawer to fool the system. A comparison of the times at which stored images were taken reveals during what interval any apparent tampering must have occurred.

To provide for additional inventory verification, the clear wall or panel 49 of the storage unit allows for manual visual inspection of the contents of the unit by security personnel without the need to open the storage unit. To render the clear panel more secure, conducting threads are embedded within the panel and an electric current through the threads is monitored by the controller. If the panel is broken or otherwise compromised, a conductivity change will be immediately apparent to the controller, whereupon suitable alarms can be generated and appropriate security personnel notified. The conducting threads also are selectively spaced to form a Faraday cage that creates a radio frequency shield at operational frequencies of the RFID chips and reader to confine RFID transmissions from the chips to the interior of the storage unit.

This verification procedure can be performed at any time, but preferably is always performed immediately following a check out or check in procedure. Periodic verification also can be performed during inactive periods to insure that the system has not been compromised in an undetected way. If, upon such periodic verification, it is determined that the inventory has been corrupted, the controller can activate suitable alarms and notify appropriate security personnel.

Object Checkout

Following user authorization as discussed above, if the user has no outstanding objects previously checked out or selects object checkout, then the object checkout procedure is implemented. First, the user identifies to the controller the object (set of keys) desired, whereupon the controller interrogates its inventory database to determine the slot in which the corresponding key tag is located. The controller then releases the lock on the drawer (or a selected drawer containing the identified slot in multi-storage unit systems) to allow the drawer to be opened. The slot containing the requested key tag and keys is indicated to the user either by displaying the coordinates of the slot on the monitor, lighting an LED next to the slot, and/or announcing the location of the slot via the audio speakers. After indicating the proper location to the user, the controller activates the locking pin solenoid corresponding to that slot to extract the locking pin from the slot and from the key tag therein. The presence detector associated with the slot detects when the key tag has been removed and the controller de-activates the solenoid to allow the locking pin to extend back into the slot. This prevents other key tags from being inserted into the slot because the locking pin now functions as an obstruction in the slot that will be encountered if a tag insertion should be attempted.

After the key tag is removed from its slot, the user is prompted to close the drawer, whereupon the locking mechanism is activated by the controller to lock the drawer securely shut. The controller then activates the RFID sensor 46 to scan the identification codes of key tags within the storage unit. Comparison of the inventory before and after the removal of the key tag reveals all changes (insertions and removals) within the drawer. Following a checkout, the controller expects to find only one key tag missing whose identification code corresponds to that of the requested key or keys. If the user somehow, either intentionally or accidentally, removed the wrong key tag or attempted to return a key tag during the checkout procedure, the inventory scan will reveal the discrepancy. Depending upon the scenario, the controller can decide whether to allow the incorrect removal or insertion, or to force the user to try again and follow proper procedures. In any event, the controller logs the suspicious event and notifies appropriate security personnel. Once the drawer is shut and secured and the inventory scan determined to be normal, the object verification procedure may be initiated, as discussed above.

Alternate Locking Pin Configurations

Figure 10:
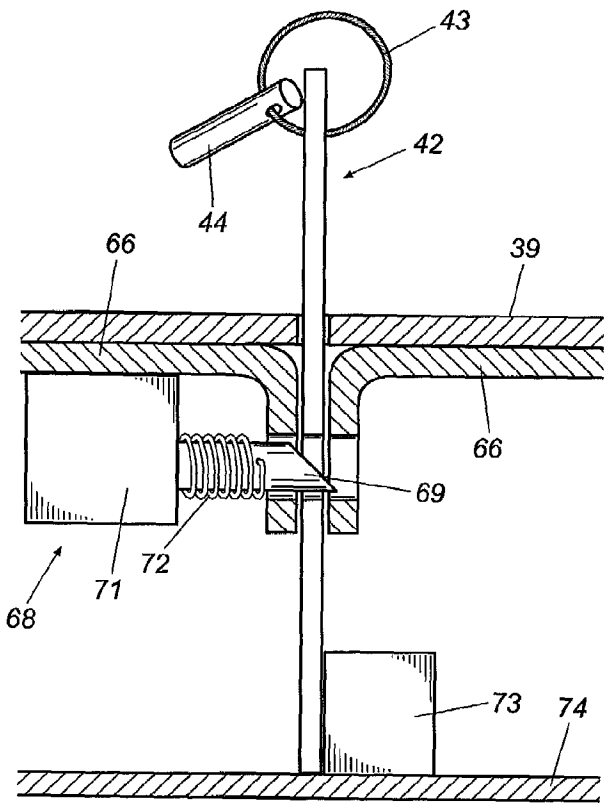
FIGS. 9 and 10 are cross sectional views through the drawer of the system shown in FIG. 1 or 7 illustrating insertion of a key tag and another embodiment of a locking pin assembly for locking the key tag in place.
Figure 9:
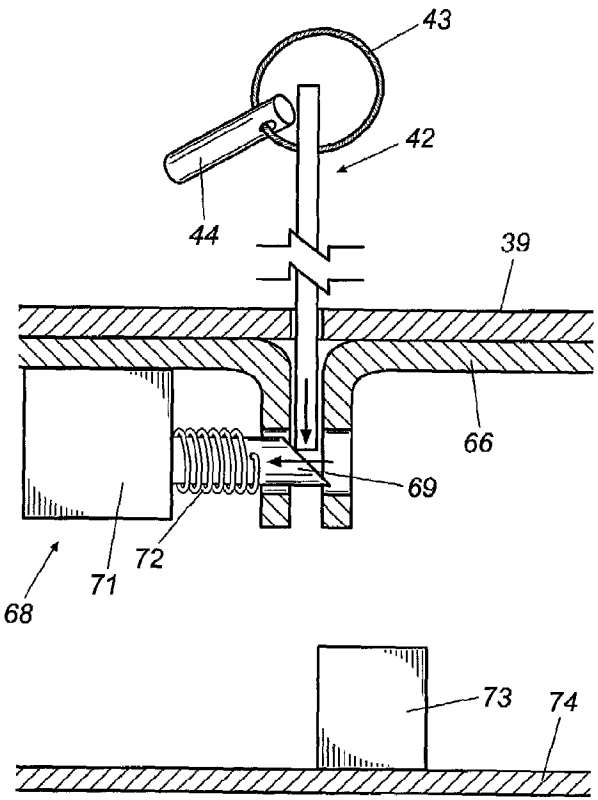

In the methodology discussed above, a user generally is forced to return a key tag to a specific slot to insure, among other things, random tag rotation. In some applications, however, such tight control of object return location within a drawer is not as important and it is desired to allow a user to return a key tag to any slot, while at the same time retaining the capability to lock key tags in their slots once inserted. To accommodate such applications, an alternate locking pin arrangement as shown in FIGS. 9 and 10 may be provided. This embodiment is similar in most respects to that of FIG. 8, but here, the end of the locking pin is canted or beveled. With such a locking pin configuration, a key tag may be inserted in the slot without the requirement that the locking pin first be retracted from the slot. More specifically, as illustrated in FIG. 9, as a key tag moves into the slot, its bottom edge engages the beveled face of the locking pin. Further downward movement of the tag forces the locking pin to the left against the force of the biasing spring 72, as indicated by the arrow in FIG. 9. The key tag continues to slide past the now retracted locking pin until the tag is fully inserted and the hole in the tag aligns with the locking pin. At this point (see FIG. 10) the locking pin springs back to its extended position under the influence of the spring 72 to lock the key tag securely in place within its slot and the presence detector 73 indicates complete insertion to the controller. The tag can now only be removed if the controller activates the solenoid to retract the locking pin such as, for instance, during an object removal procedure.

Alternate Storage Unit Configurations

Figure 11:
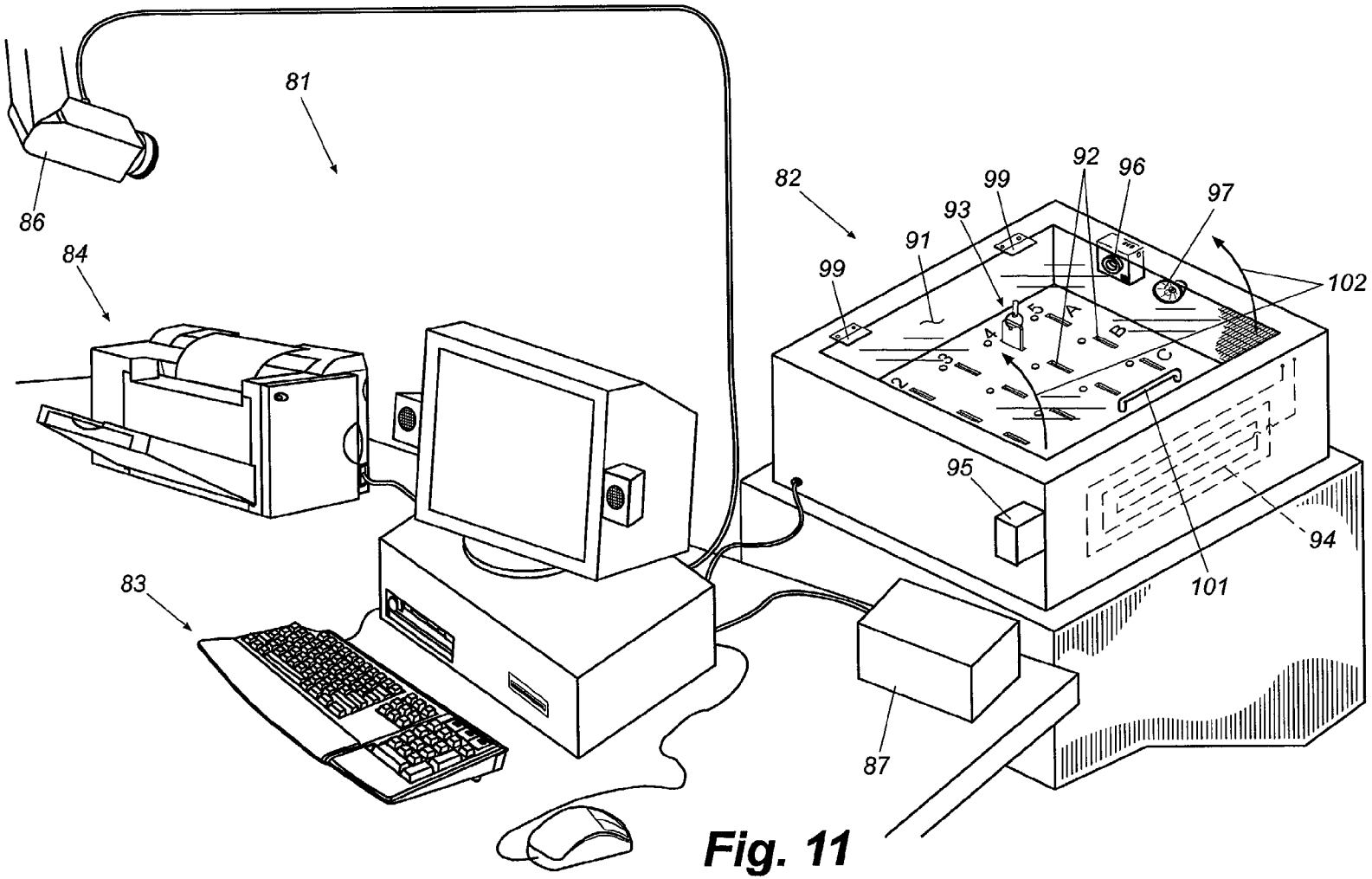
FIG. 11 is a perspective partially schematic view of an object control and tracking system that includes a storage unit with a clear openable door rather than a slidable drawer.

The storage unit illustrated in FIGS. 1 and 7 are portrayed as a cabinet with a sliding drawer. In some applications, it is more desirable for the cabinet to be accessed through an openable door rather than a drawer. A possible alternate embodiment of a storage unit forming part of an object control system is illustrated in FIG. 11. Here, the object tracking system 81 includes a storage unit 82, a computer controller 83, a printer 84, an external security camera 86, a biometric identification unit 87, and an external RFID reader 95, all as discussed above. The storage unit 82 has a fixed internal panel 91 with an array of slots 92 configured to receive key tags 93. An internal global RFID reader 94 is provided in the storage unit for reading RFID chips associated with key tags in the storage unit and an internal camera 96 with wide angle lens and a corresponding light source 97 illuminates the interior of the storage unit for imaging the inventory of the unit, also as detailed above.

A transparent panel 98 with embedded conductive security threads is attached to the storage unit with hinges 99 along one edge and a handle is provided adjacent the opposite edge. In this embodiment, the storage unit locking mechanism (not visible) is configured to lock and secure the hinged panel shut instead of securing a sliding drawer. The functionality of the storage unit configuration of FIG. 11 is the same as that previously discussed for the sliding drawer configuration, except that the clear panel is hinged open to access key tags and keys in the storage unit rather than opening a drawer.

Figure 12:
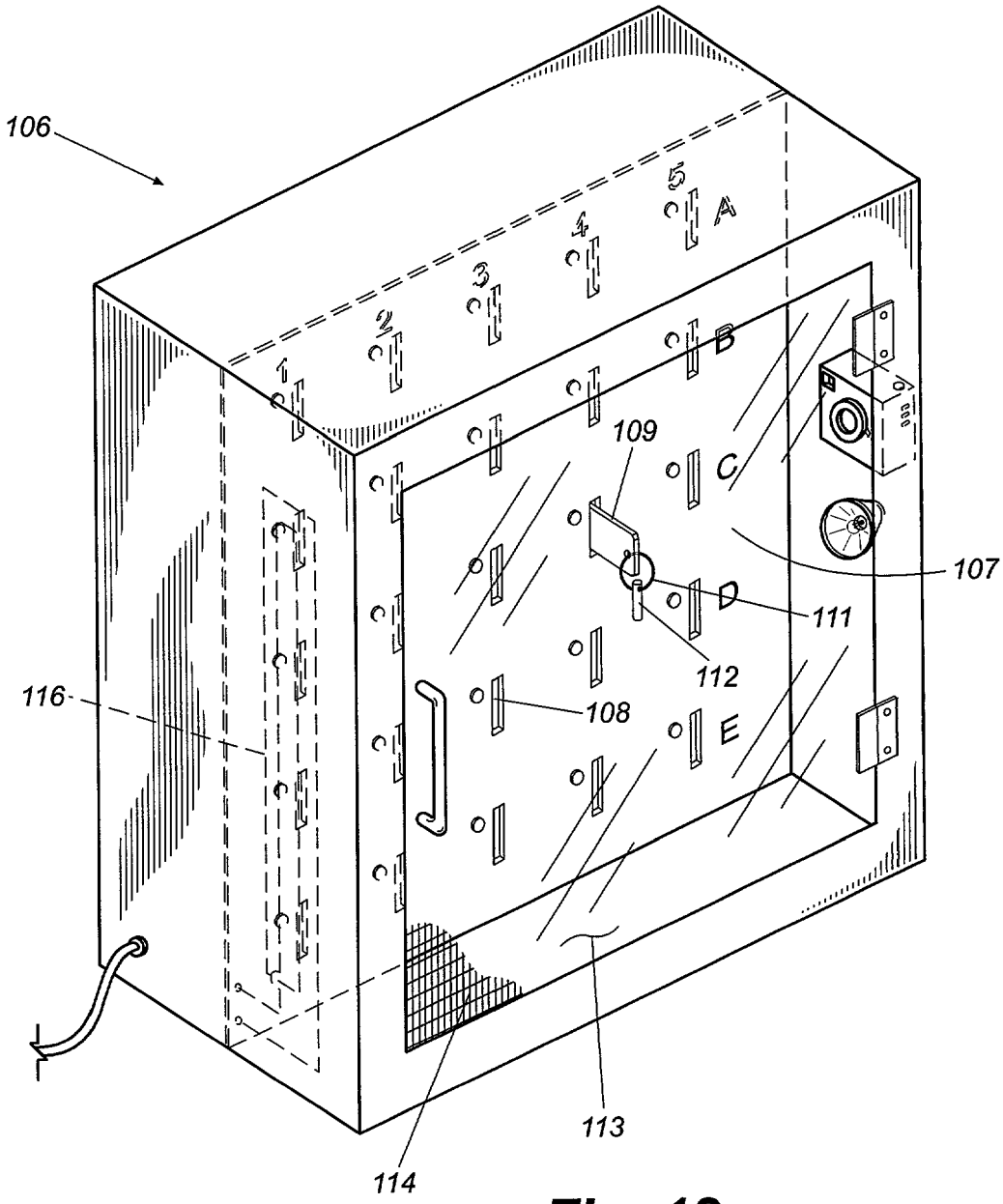
FIG. 12 is a perspective view showing an alternate embodiment of a storage unit in the form of a wall mountable cabinet with hinged clear door.
Figure 13:
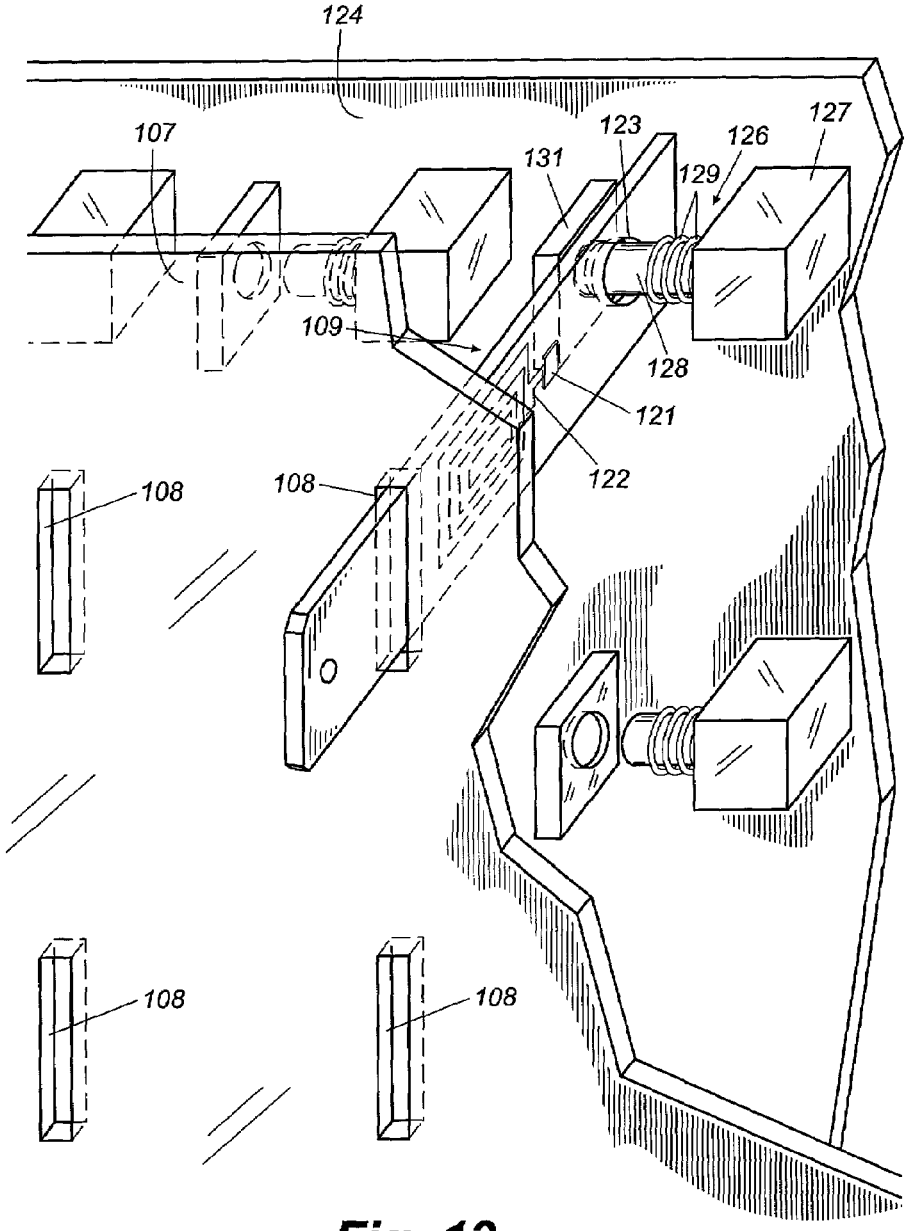
FIG. 13 is a perspective view of a portion of the cabinet of FIG. 12 illustrating insertion of a key tag into a slot of the cabinet and the associated locking pin assembly.

In some other applications, it is desirable to use a storage unit on a wall. A storage unit suitable for such applications is illustrated in FIGS. 12 and 13. The storage unit 106 has a fixed internal panel 107 with an array of slots 108 for receiving key tags 109 having tamper proof key tethers 111 and RFID chip fobs 112. An internal RFID reader 116 is provided in the storage unit for reading the identification codes of RFID chips on key tags in the storage unit is provided. A camera and light source is provided as in prior embodiments for image verification procedures. A clear panel 113 is hingedly attached to the storage unit and a locking mechanism (not visible) is configured to be activated by an attached computer controller for locking and unlocking the clear panel. As before, conducting threads 114 are embedded in the clear panel for added security. In this embodiment, the inventory (keys) is accessed by opening the front clear panel. The panel 107 in this embodiment is oriented vertically rather than horizontally and the key tags are inserted horizontally into their slots. With key tags inserted, their RFID chip fobs hang down to be interrogated by the internal RFID reader 116.

FIG. 13 illustrates a key tag and slot arrangement usable with the vertically oriented storage unit of FIG. 12. Here, the key tag 109 is shown inserted horizontally into a slot 108 in the panel 107. Instead of having an RFID chip fob attached to the key tether of the key tag, an RFID chip and associated antenna are attached to or embedded within the key tag itself. The identification code stored in the RFID chip is read in this embodiment by the internal RFID reader, just as with other embodiments with the RFID chip embedded in a fob attached to the tether. A hole 123 is formed in the distal end of the tag and is positioned to align with the locking pin 128 of a locking pin assembly 126 when the key tag is fully inserted into its slot. As with prior embodiments, the locking pin assembly includes a solenoid 127 and biasing spring 129 for locking and unlocking a key tag in the slot. A locking pin stop 131 may be provided on a backplane 124 or on the back surface of the storage unit to limit the travel of the locking pin and to prevent a key tag from being forcibly removed from a slot without retraction of the locking pin. Other than the described modifications, methods of use of a system incorporating a vertical cabinet and tag as shown in FIGS. 12 and 13 preferably are the same as described above relative to the embodiment of FIG. 7.

Alternate Key Tag Configurations

Figure 14:
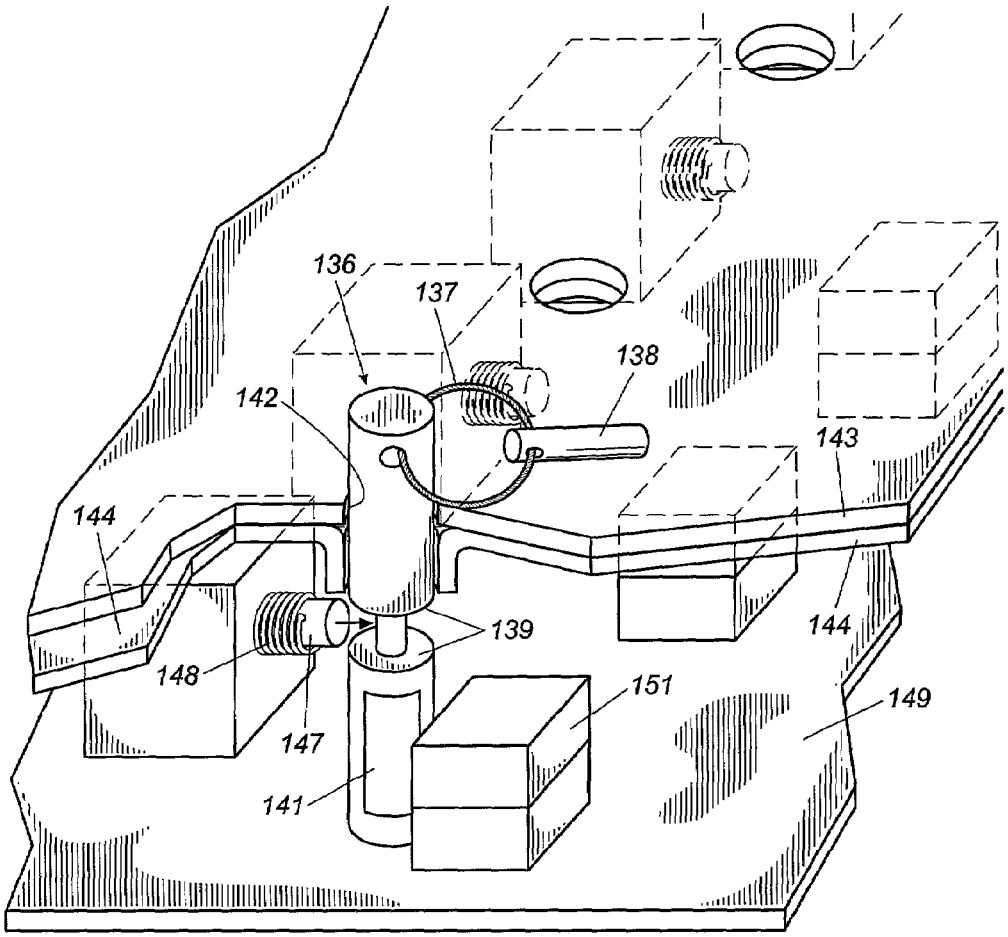
FIG. 14 is a cross sectional view of a portion of the interior of a storage unit illustrating an alternate configuration of a key tag and the associated locking pin assembly.
Figure 15:
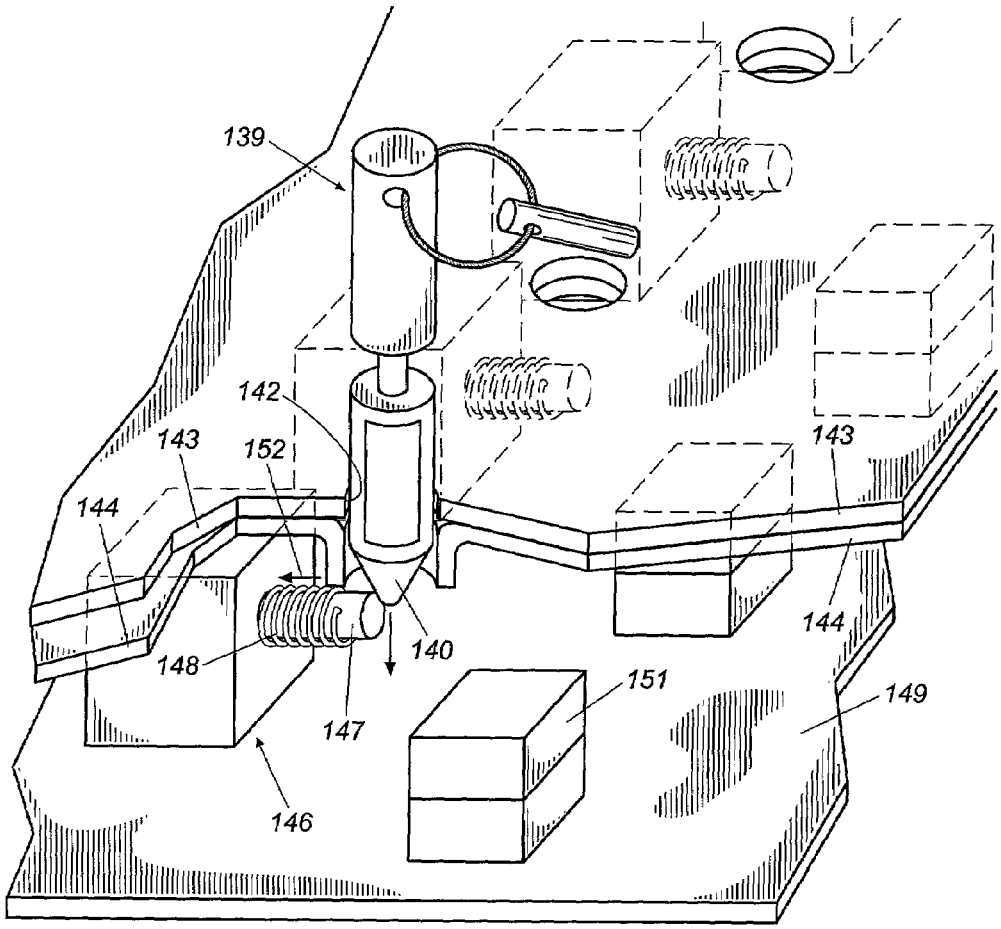
FIG. 15. is a cross sectional view of a portion of the interior of a storage unit illustrating another alternate configuration of a key tag and the associated locking pin assembly.

Key tags having shapes other than rectangular or flat also are envisioned. FIGS. 14 and 15 illustrate two alternate embodiments of key tags that are generally cylindrical rather than square or flat. In FIG. 14, a generally cylindrical key tag 136 is shown inserted into a corresponding round slot or socket 142 in the panel 143 of an object tracking storage unit. The key tag 136 is formed with an annular groove 139 intermediate its ends and positioned to align with the locking pin 147 of a locking pin assembly 146. The locking pin assembly includes a solenoid for retracting the locking pin and a biasing spring 148 for biasing the locking pin to its extended position. The key tag of this embodiment has an embedded RFID chip and associated antenna 141 on its bottom end portion and also has and RFID chip fob 138 attached to a tamper proof tether 137 to which keys are attached during use. A combination presence detector and RFID reader 157 is located on a backplane 149 for detecting complete insertion of the key tag in its slot and for reading the identification code of the embedded RFID chip 141 when the key tag is so inserted. Operationally, when a key tag is returned, the controller indicates the appropriate key slot for return of the key tag as discussed above and the solenoid of the selected slot is retracted to allow insertion. The cylindrical key tag is then inserted in its circular hole in the panel. After the presence detector and internal RFID reader indicate that the key tag is fully inserted, the solenoid is deactivated, whereupon the biasing spring moves the locking pin back to its extended position to move the tip of the locking pin into the annular groove to lock the key tag in place. In the removal mode, first the solenoid is activated to retract the locking pin to unlock the associated key tag allowing removal thereof. After the key tag has been removed, the solenoid is deactivated to extend the locking pin back into the slot to block any future unapproved insertions of key tags in the slot.

For applications where key return is allowed to any slot, a cylindrical key tag embodiment with a beveled or conical end is envisioned and illustrated in FIG. 15. During insertion, the beveled end 140 of the cylindrical key tag 139 pushes the locking pin 147 back into the solenoid. Once the tag is inserted completely into its slot 142, the biasing spring forces the locking pin 147 into the annular groove of the key tag thereby locking the key tag in place in its slot. The presence detector then registers the presence of the key tag and initiates the object verification procedures discussed above.

Key Tag Orientation

Figure 16:
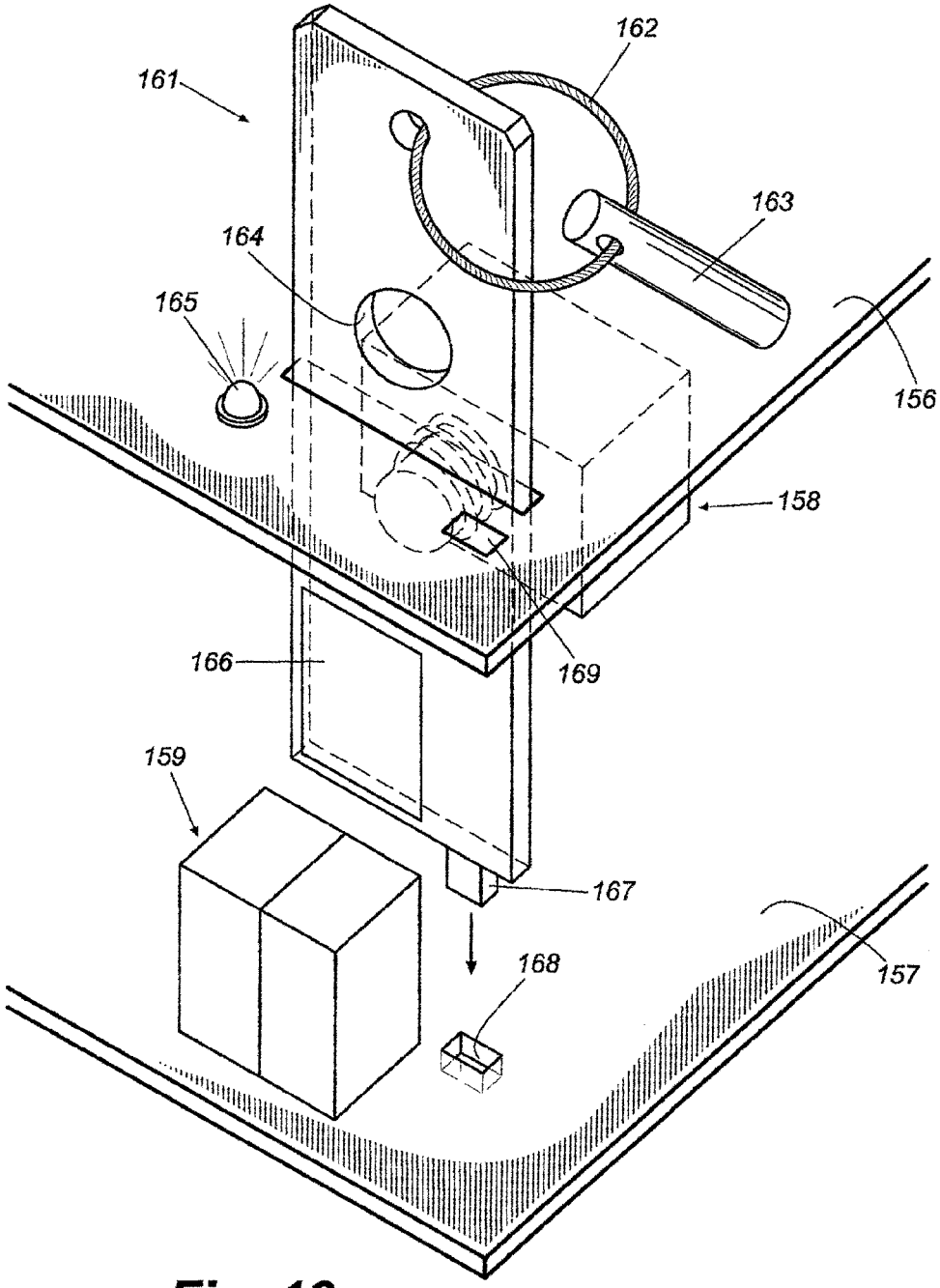
FIG. 16 is a perspective view of a portion of the interior of a storage unit illustrating one embodiment of a system for ensuring proper key tag orientation.

In some scenarios, it is required that key tags be inserted in a particular orientation in their respective slots of an object tracking system. For example, such a requirement might be imposed to allow for simpler or cheaper ID chips, such as a touch memory device, or a more robust RFID tag and reader combination. FIGS. 16 through 20 illustrate various embodiments of key tags and slot configurations for ensuring that key tags are inserted into their slots in only one orientation. In the embodiment of FIG. 16, a key tag 161 is shown being inserted into a slot of a storage unit. The key tag and slot configuration share many of the attributes previously discussed, including an external RFID chip fob 163 attached to a tamper proof tether 162 and a locking hole 164 in the tag for receiving the locking pin of a locking pin assembly 158. In the illustrated embodiment, a second internal RFID chip and associated antenna 166 is attached to or embedded within the tag on its bottom end portion and a combination RFID reader and presence detector 159 is fixed to the backplane 157 for detecting insertion of a tag and reading its internal RFID chip. An LED 165 is illustrated on the panel adjacent the slot for indicating to a user the slot of a requested tag or the slot into which a returning tag should be inserted.

The tag 161 is formed with an alignment plug 167 that is sized and positioned to be received into a corresponding alignment socket 168 in the backplane when the key tag is properly inserted and aligned within its slot. An orientation indicator is printed on the panel 156 as an indication to the user of the proper insertion orientation of the tag. It will be seen from this configuration that only in the proper orientation will the alignment plug slip into the alignment socket in the backplane. In the reverse improper orientation, the alignment plug simply engages the backplane stopping further insertion of the key tag and preventing the presence detector from indicating a successful tag insertion. Only when the key tag is inserted fully and in the proper orientation will the presence detector indicate successful insertion, whereupon the locking pin assembly can be activated as described above to lock the key tag in place. Thus, the alignment plug and socket insures that the key tag is inserted into its slot in the proper orientation before the system will continue with further processing.

Figure 17:
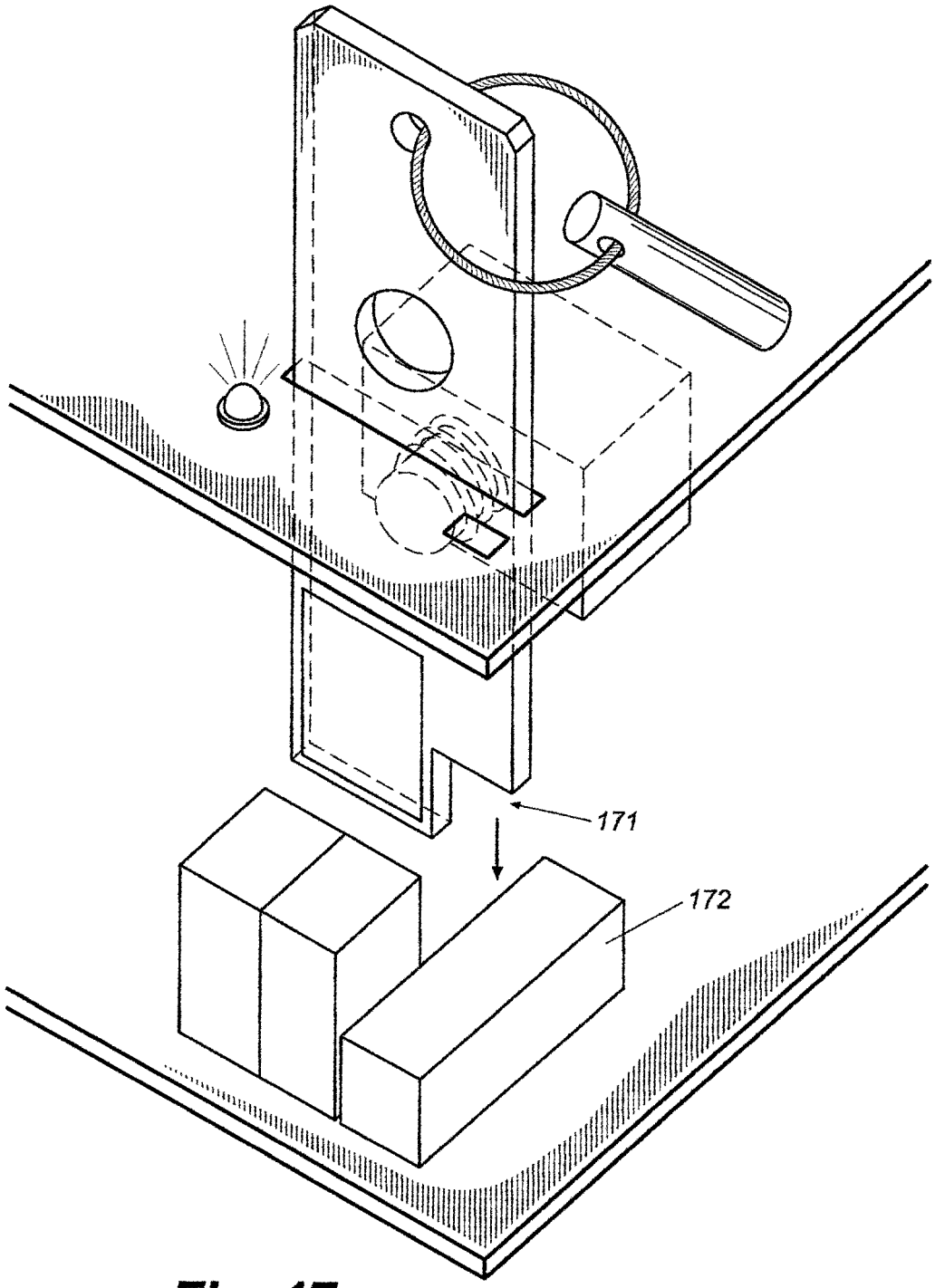
FIG. 17 is a perspective view of a portion of the interior of a storage unit illustrating another embodiment of a system for ensuring proper key tag orientation.
Figure 18:
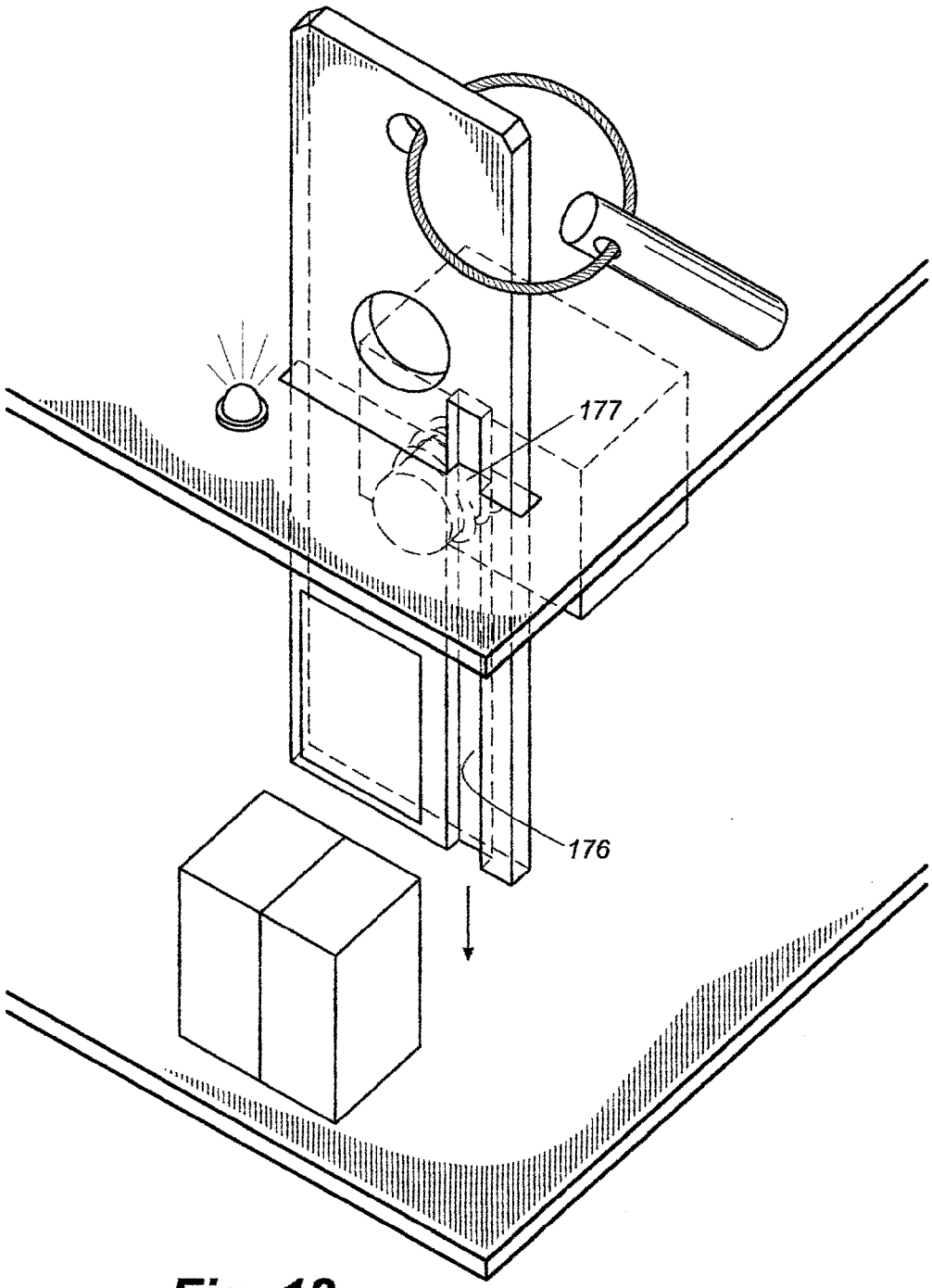
FIG. 18 is a perspective view of a portion of the interior of a storage unit illustrating another embodiment of a system for ensuring proper key tag orientation.
Figure 19:
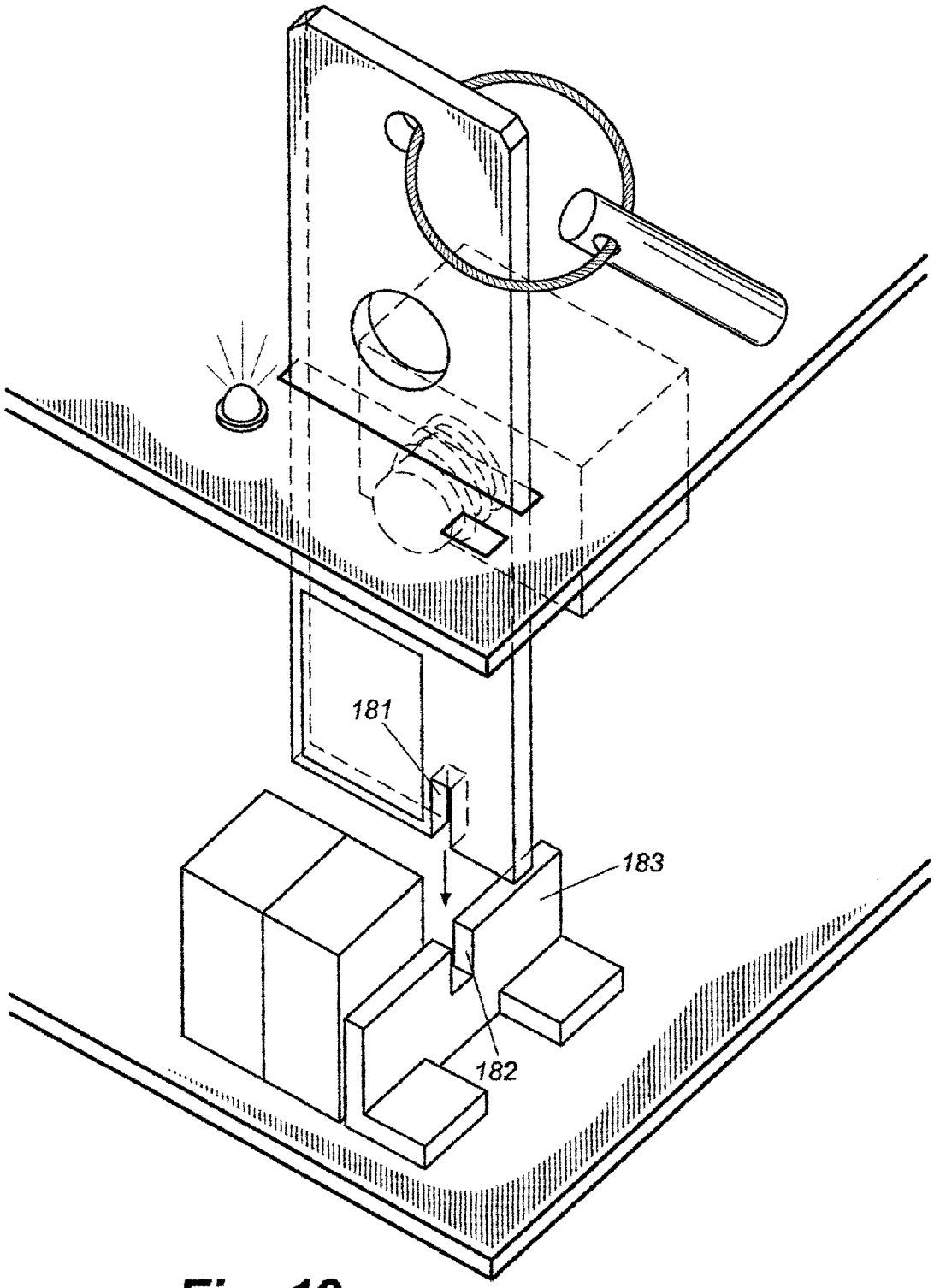
FIG. 19 is a perspective view of a portion of the interior of a storage unit illustrating yet another embodiment of a system for ensuring proper key tag orientation.
Figure 20:
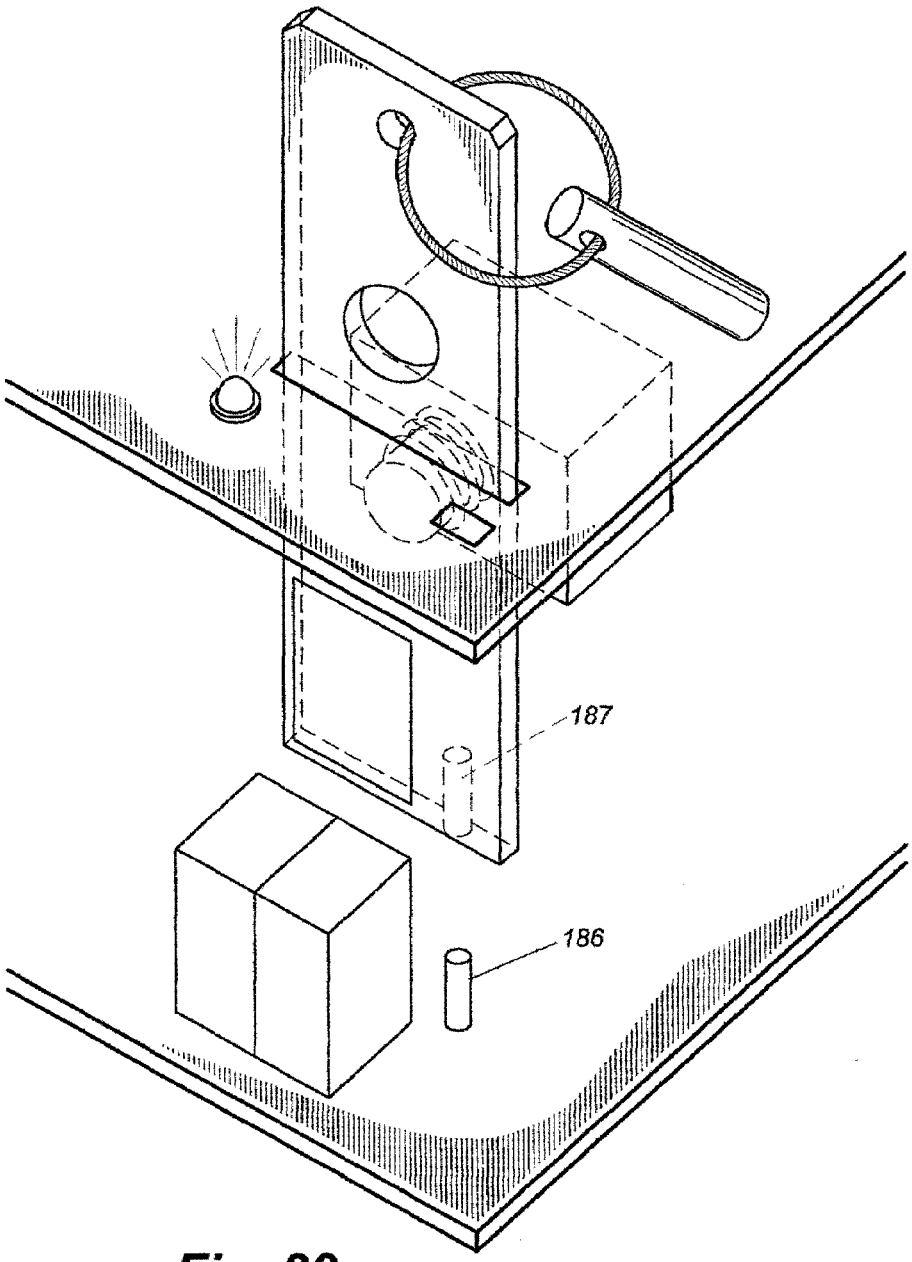
FIG. 20 is a perspective view of a portion of the interior of a storage unit illustrating still another embodiment of a system for ensuring proper key tag orientation.

FIGS. 17 through 20 illustrate other possible configurations of tags and sockets that insure proper orientation when tags are inserted. The key tag in FIG. 17 is formed with an alignment notch 171 on one of its bottom corners and a corresponding alignment bar or block 172 is disposed on the backplane. In the proper orientation, the notch 171 aligns with the block 172 permitting complete insertion. However, in the wrong orientation, the other bottom corner of the key tag engages the block 172, preventing successful insertion and further processing. In FIG. 18, the key tag is formed with an elongated alignment slot 176 along one edge portion and the slot is formed with a corresponding alignment key 177. Only in the proper orientation will the alignment slot line up with the alignment key allowing insertion of the key tag in the slot. In FIG. 19 the key tag is formed with an alignment notch 181 at one bottom corner portion and an alignment bracket 183 having a corresponding alignment notch 182 is fixed to the backplane. Only in the proper orientation of the key tag will the two alignment notches line up to allow complete insertion of the key tag into the slot. Finally, FIG. 20 illustrates a key tag having a cylindrical alignment pin receptacle 187 bored in its bottom edge adjacent one corner. A corresponding alignment pin 186 is fixed to the backplane and only in the proper orientation will the alignment pin receptacle line up with and receive the alignment pin to allow complete insertion of the key tag. As an additional feature, the alignment pin also can serve as a data contact for uploading or downloading information from an ID chip on the key tag or as a power conduit for providing power to electronic components on the key tag.

Multiple RFID Chips on Key Tags

Several embodiments described above exhibit multiple (2) RFID chip and antenna sets associated with each key tag. For instance, in the embodiments of FIGS. 14 through 20 each key tag has an internal RFID chip on or in the body of the key tag and an RFID chip fob attached to the tamper proof tether to which keys are attached during use. It is preferred that the chips be independently readable by two corresponding RFID readers. This can be accomplished in several possible ways. One chip, for instance, might implement a short range read technology for being read by a short range reader (e.g. the reader in the storage unit) while the other might implement a long range read technology for being read by a long range reader (e.g. an external reader in the vicinity of the object tracking system). Alternatively, the two chips can be configured to operate at different radio frequencies to be read independently by readers operating at these same frequencies. Also, the fundamental technology of the two chips can be different. For example, one chip can operate with an inductive antenna while the other operates with a capacitive antenna. Indeed, the local "on the tag" chip might even be a contact memory button while the external RFID chip fob might contain an RFID chip and associated antenna. In any event, the two chips or memory devices are readable separately by corresponding readers.

The use of dual or multiple RFID chips is useful in high security applications. For instance, an authorized user might be allowed to check out keys, but to prevent unauthorized duplication, it is desired that the checked out keys do not leave the vicinity of the object tracking system. For such an application, the RFID chip embedded in the key tag might be a short range read chip for being read by an internal RFID reader within the storage unit in the manner described above for checkout and check in of keys. The external RFID chip in the key fob attached to the tamper proof tether, however, might be a long range read chip readable by an external RFID reader such as reader 52 in FIG. 7. The external RFID reader in this scenario periodically polls checked-out key tags to ensure that they are in the vicinity of the object tracking system (i.e. that they are within the read range of the external reader). If tags are moved out of the vicinity, the controller can be programmed to sound appropriate alarms and/or alert security personnel.

Figure 21:
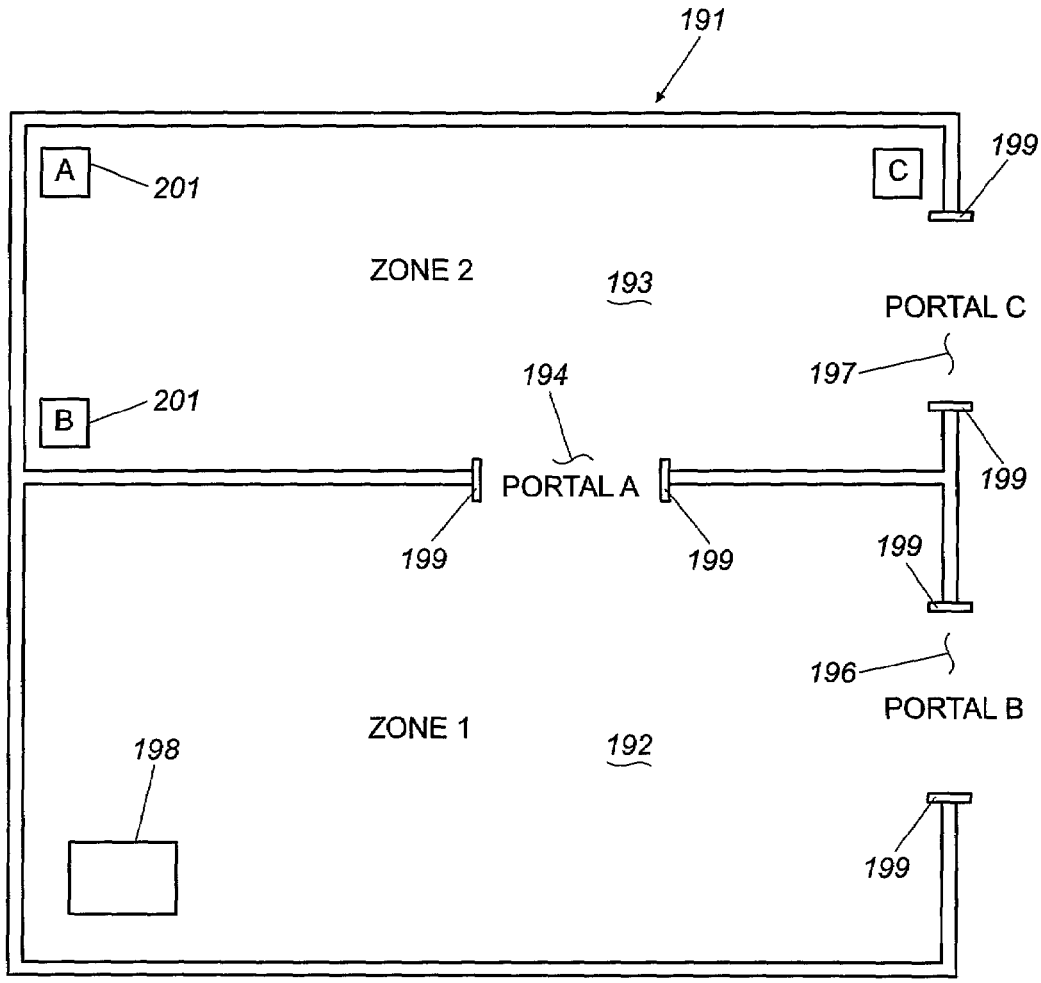
FIG. 21 is a top plan view illustrating one embodiment of incorporating object tracking from zone to zone in a building while the object is checked out, according to the invention.
Figure 22:
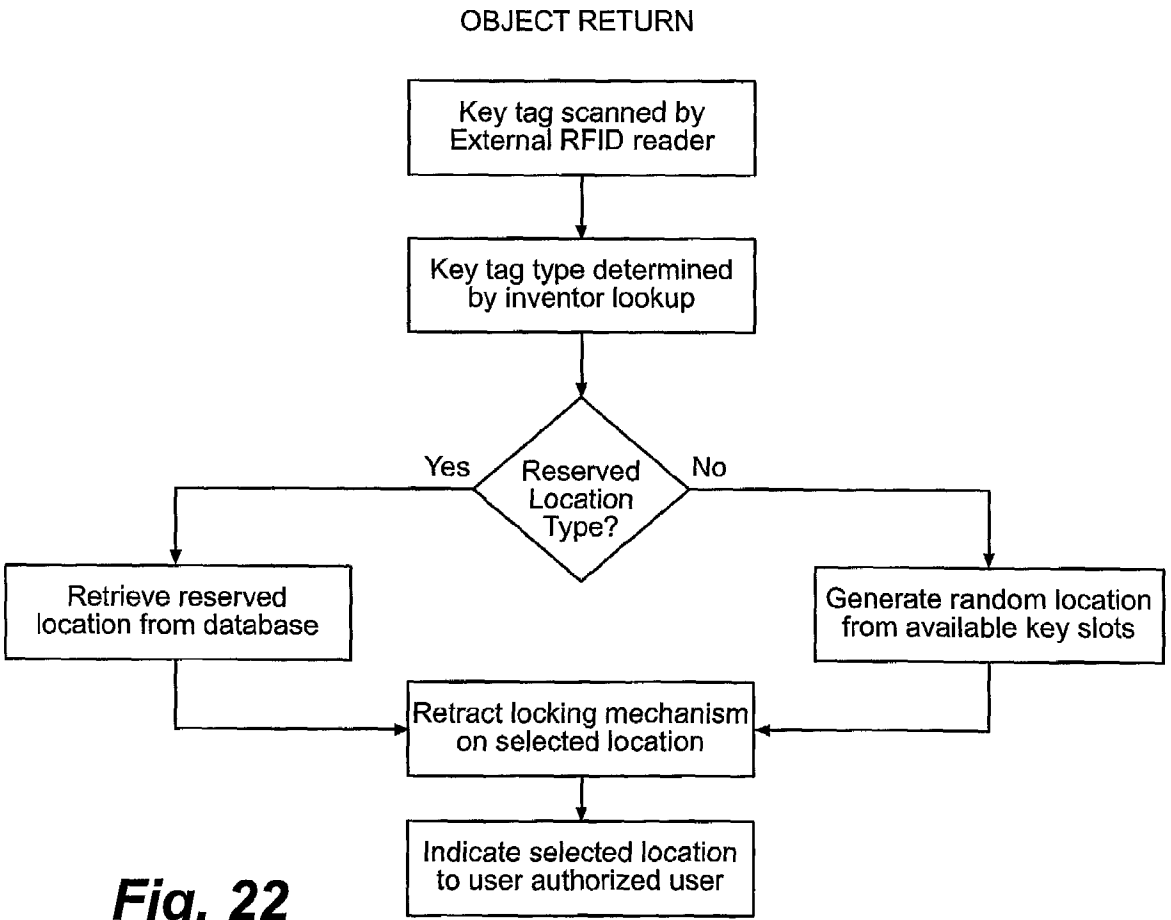
FIG. 22 is a functional flow chart illustrating one embodiment of an object return function implementable with the system illustrated in FIG. 7.

For some applications, the possible read range of the external RFID reader might be inadequate for tracking keys within a larger area. In these applications, a zonal security arrangement is envisioned, as illustrated schematically in FIG. 21. Here, an object control system 198 is located in a room 192 of a larger building, the room being designated "Zone 1." Another room 193 is designated "Zone 2." A door or portal 194 connects the two rooms and doors or portals 196 and 197 each exits a corresponding room or zone. In Zone 2, three readers A, B, and C (each designated with reference numeral 201) with directional antennas are located in the corners of the room. Further, RFID readers 199 are located at each portal 194, 196, and 197 as illustrated. All of the RFID readers are coupled to the object control system by means of appropriate communications links.

With such a system, the external RFID reader of the object control system can monitor the presence of key tags (or other objects) within Zone 1. If a checked out set of keys is moved through one of the portals, say from Zone 1 to Zone 2, then the RFID readers detect the transition and transmit this information to the controller. The controller now knows that the checked out keys are in Zone 2. If a user attempts to transport checked out keys out of the building through portals 196 or 197, this event is detected by the RFID readers at these portals and transmitted back to the controller. Depending upon the restrictive rules, the controller can either log the event for future use or generate appropriate alarms and inform security personnel that checked out keys are being transported out of the building. The level of security may be enhanced further by providing users with RFID identification badges that are readable by the various RFID readers within the building, the user identifications being transmitted to the controller. In this way, the controller can ensure that only the authorized person who checked out the keys or other object is transporting the checked out item within the building and through the portals. Any unauthorized behavior is logged by the controller and appropriate alarms can be generated depending upon security rules in force. If more precise location of checked out objects within a zone is desired, the three readers 201 with directional antennae can be used in conjunction with triangulation techniques to determine the precise location of a checked out object within the zone. This has application in, for example, automotive dealerships where the locations of lost or intentionally hoarded keys can be pinpointed at any time.

Another advantage of dual RFID chips on key tags is in tamper detection. When such a key tag is under control of the object control system, the key tag is locked in place by the locking pin assembly associated with its slot. To protect against an ill-intentioned user trying to overpower the locking pin forcibly, the key tag is weakened along a break line such as, for example, the naturally thinner region of the annular groove in the embodiments of FIGS. 14 and 15. Any attempted forcible removal of the key tag will cause the key tag to break along the break line. The presence detector and internal RFID reader will continue to log the presence of the key tag. However, the external RFID reader within the storage unit will note the absence of the upper portion of the key tag. This discrepancy can be logged and appropriate alarms generated for use by security personnel.

Embedded RFID chips and antenna within objects themselves, such as within the bodies of keys, can be the foundation of an even higher security dual RFID chip system. In such a system, the RFID chip embedded within the key tag is utilized in the usual key tag inventory functions discussed above. However, the global RFID reader in the storage unit can note the presence or absence of each key assigned to their key tags by reading the RFID chip embedded within the keys.

Presence Detectors

The presence detectors discussed above relative to some embodiments of the invention may be implemented with an array of technologies such as, for example, electrical switches, conductive contacts that conduct through a corresponding conductive area on each key tag, photoconductive optical switches utilizing key tags to make or break and optical signal, reed switches that are activated by magnetic material embedded within the key tags, or even contact memory chips or buttons that transmit codes to the controller to signal the presence of a key tag. These and other equivalent techniques for detecting the presence of tags within a storage unit are envisioned and all should be considered to be within the scope of the invention.

Non Locking Storage Units

The storage units discussed above secure the key tags in their slots with locking pin arrangements and also secure or lock the storage units within which keys are stored against unauthorized access. In some applications, ease of use or other security protections might warrant a system in which the storage unit or units are not separately secured or even enclosed. In these applications, the locking pin mechanisms for locking key tags in their slots are relied upon solely for securing key tags, ensuring against removal of non-requested keys, and forcing key tag rotation within the storage unit.

The invention has been described herein in terms of preferred embodiments and methodologies considered by the inventor to be the best mode of carrying out the various functions of the invention. It will be understood by those of skill in the art, however, that various additions, deletions, and modifications to the illustrated embodiments might be implemented without departing from the scope of the invention. For instance, while RFID chips and associated antenna are preferred in most applications, any technology by which unique identification codes can be associated with key tags and read or detected is equivalent to the RFID chips of the preferred embodiments. Other storage unit configurations also are possible. While the invention has been described within the context of tracking keys for clarity of description, the techniques and methodologies of this invention clearly are applicable to tracking a wide variety of objects other than keys such as, for instance, narcotics, jewelry, secret documents, electronic equipment, and other types of objects. In fact, one particularly salient application of the present invention involves the tracking of electronic equipment and particularly data gathering wands or devices used by parcel post services. These expensive devices are used by employees to scan optical bar codes on parcel packages at various stages in the delivery process. They generally checked out by employees from a central storage location at the beginning of a shift and checked back in at the end of a shift. A bank of sockets for receiving and storing the devices is located at the storage location. When a device is returned at the end of a shift, it is placed in a socket where it its batteries are recharged. The sockets are coupled through a communications link to a central computer and, when a device is placed in a socket, the data that has been gathered with the device may be downloaded to the computer for use in tracking packages. A major problem in these scenarios is that the data gathering devices can be lost, misplaced, or stolen with little if any audit trail having been created to locate the devices. The present invention is applicable to tracking these data gathering devices in such an environment. More particularly, each of the data gathering devices is provided with at least one RFID chip and associated antenna, which can simply be attached to the surface of the device without the need to modify the device. The normal storage sockets in which the devices are stored are mounted in a storage unit of the object tracking system, which may be a slidable drawer, openable cabinet, or a wall mounted unit as discussed above or may take another form as needed. Other elements of the object tracking system are included, such as the computer controller, biometric identification unit, internal digital camera, external digital camera, and workload scheduling system as shown in FIG. 7. Employees of the parcel service are then required to follow the login, checkout and check in procedures discussed in detail above. The workload scheduling functionality discussed above may be implemented to assign particular data units to each employee based on the condition of the unit (battery usage, etc.) or on other factors. If an employee takes the wrong unit, the controller notes this event and may give the employee an opportunity to correct the problem or may notify security personnel. Digital images and/or manual visual inspection of the inventory in the storage unit verifies the conditions of stored devices, as detailed above, and audit and device condition reports can be generated as needed. The controller can be coupled to the main parcel service computer to receive information about the status of stored units such as, for example, battery status and indications of faulty units, such as the failure of a returned unit to initiate download of its stored information. Maintenance schedules can be developed by the controller based on this condition information. With such a system, all of the advantages and securities of the present invention can be applied to the tracking of such data gathering devices, or indeed any equipment that is checked out and used by employees in the course of carrying out their duties.

Another envisioned application of the present invention is in the field of automated maintenance project scheduling at, for instance, an apartment complex or an automotive dealership. In such environments, customers continuously require service. In an apartment complex, for example, tenants may call in with a leaky sink, an overflowing toilet, or another problem that must be addressed by maintenance personnel. In applying the present invention to such a scenario, a central dispatcher might be assigned to answer calls from tenants and enter the required maintenance projects into the workload scheduling system of the invention. The workload scheduling system is programmed to prioritize the projects according to severity (an overflowing toilet need immediate attention whereas, for instance, a stuck window does not) and to assign the project to one or more maintenance employees. This information is then transmitted to the computer controller, which is programmed to advise the maintenance person (user) of his next assignment when he next logs into the system. The controller then may assign the particular key to the apartment needing maintenance to the maintenance person and allow him to remove only that key from the storage unit, as discussed above. In this way, maintenance personnel can not avoid undesirable maintenance projects and select only the more desirable projects. The same methodology applies to mechanics at an automotive dealership who are assigned vehicle maintenance projects. Thus, the system and methodology of the present invention, in addition to providing all the benefits and advantages discussed above, the present invention also can serve as a project prioritization and scheduling system that forces maintenance personnel assigned to a particular task to attend to the assigned task.

Finally, it will be observed that the term "scheduling information" is used in the context of various discussions in the above disclosure. Drawing from these discussions, it will be understood that the term "scheduling information" as used herein and in the claims means any type or character of information upon which the controller may base decisions to assign certain objects to certain users. Scheduling information might include, for instance, a user's work schedule, a users task assignment, whether it is the beginning or end of a user's shift, the condition of objects stored in a storage unit, the nature of a repair or other task assigned to the user, and any other type of information upon which specific object/user pairings may be determined.

These and other variations of the embodiments illustrated herein are all possible and may be made without departing from the spirit and scope of the invention as set forth in the claims.

What is claimed is:

1. A system for tracking and controlling access to a plurality of objects that are checked out and checked back in by users, said system comprising:

at least one readable identification code stored on each of said objects;

a storage unit having a plurality of receptacles, each receptacle configured to receive and store an object during periods when the object is not checked out by a user;

at least one reader associated with said storage unit for reading the identification codes of objects present in said storage unit and thereby determining which objects are in the storage unit and which objects are not in the storage unit;

a computer controller coupled to said storage unit for receiving identification codes of objects in said storage unit;

said controller being programmed to receive scheduling information regarding users and objects and to assign one or more of the objects stored in said storage unit to a user when the user logs in to the system based upon the scheduling information.

2. A system for tracking and controlling access to a plurality of objects as claimed in claim 1 and wherein the scheduling information includes the scheduled work times of users and wherein said controller is programmed to deny access to objects in the storage unit to users at times other than their scheduled work times.

3. A system for tracking and controlling access to a plurality of objects as claimed in claim 1 and wherein the scheduling information includes information regarding the conditions of objects in said storage unit and wherein said controller is programmed to assign objects to users based at least in part upon the conditions of the objects.

4. A system for tracking and controlling access to a plurality of objects as claimed in claim 3 and wherein the objects include electronic equipment and wherein the information regarding the conditions of objects includes battery usage.

5. A system for tracking and controlling access to a plurality of objects as claimed in claim 3 and wherein the objects include electronic equipment and wherein the information regarding the conditions of objects includes information indicating a faulty condition of the objects.

6. A system for tracking and controlling access to a plurality of objects as claimed in claim 3 and wherein the objects include electronic equipment that downloads data while in said storage unit and wherein the information regarding the conditions of the objects includes information regarding whether a data download is in progress for the objects.

7. A system for tracking and controlling access to a plurality of objects as claimed in claim 1 and wherein said scheduling information includes information regarding work assignments of users, said controller being programmed to assign and allow the user to access specific ones of said objects based upon the work assignment of the user.

8. A system for tracking and controlling access to a plurality of objects as claimed in claim 7 and wherein the objects are keys, the users are maintenance personnel, the work assignments are maintenance tasks, and wherein each user is assigned and provided access by the controller to the keys that permit the user to perform the maintenance task assigned to the user.

9. A system for tracking and controlling access to a plurality of objects as claimed in claim 8 and wherein the users are maintenance personnel for an apartment complex and wherein said keys are keys to apartments.

10. A system for tracking and controlling access to a plurality of objects as claimed in claim 8 and wherein the maintenance personnel are mechanics at an automotive service center and wherein said keys are keys to vehicles.

11. The system of claim 7 and wherein the objects are keys, the users are delivery drivers, the work assignments include a specific delivery truck appropriate for deliveries to be made, and wherein each user is assigned and provided access by the controller to the keys to the specific delivery truck.

12. A system for tracking and controlling access to a plurality of objects as claimed in claim 1 and further comprising a biometric identification unit coupled to said controller, said biometric identification unit extracting biometric information from users when the users log in to the system and said controller being programmed to identify each user based upon the extracted biometric information with a minimum of required user interaction with the controller.

13. A system for tracking and controlling access to a plurality of objects as claimed in claim 12 and wherein said biometric identification unit includes a fingerprint scanner, said controller identifying users based upon scans of their fingerprints.

14. The system of claim 13 and wherein said at least one readable code is stored in an RFID chip that transmits the stored code via radio frequency transmission and wherein said reader is an RFID reader.

15. A system for tracking and controlling access to a plurality of objects as claimed in claim 12 and wherein said biometric identification unit includes a facial feature scanner, said controller identifying users based upon scans of their facial features.

16. A system for tracking and controlling access to a plurality of objects as claimed in claim 12 and wherein said biometric identification unit includes a retinal eye scanner, said controller identifying users based upon scans of their retinas.

17. A system for tracking and controlling access to a plurality of objects as claimed in claim 1 and wherein said controller receives scheduling information regarding users from a remote workload scheduling system.

18. A system for tracking and controlling access to a plurality of objects as claimed in claim 1 and further including a camera in said storage unit for imaging objects stored in said storage unit, said images providing a visual verification of the conditions of objects in said storage unit.

19. A system for tracking and controlling access to a plurality of objects as claimed in claim 1 and further including a transparent panel in said storage unit to allow manual visual inspection of the conditions of objects in said storage unit.

20. A system for tracking and controlling access to a plurality of objects that are checked out and checked back in by users, said system comprising:

at least one readable identification code stored on each of said objects;

a storage unit having a plurality of receptacles, each receptacle configured to receive and store an object during periods when the object is not checked out by a user;

at least one reader associated with said storage unit for reading the identification codes of objects present in said storage unit and thereby determining which objects are in the storage unit and which objects are not in the storage unit;

a computer controller coupled to said storage unit for receiving identification codes of objects in said storage unit;

at least one external reader for reading the identification codes of objects outside of and in the vicinity of said storage unit;

said external reader being coupled to said controller for communicating read identification codes thereto;

said controller being programmed to determine, based upon identification codes received from said external reader, if objects leave the vicinity of the storage unit and to take appropriate action based upon said determination.

21. The system of claim 20 and further comprising two readable identification codes stored on each object, said reader associated with said storage unit reading one identification code and said external reader reading the other identification code.

22. The system of claim 21 and wherein at least one of said identification codes is stored in an RFID chip and is transmitted to its corresponding reader via radio frequency transmission.

23. The system of claim 21 and wherein said two identification codes are stored in two RFID chips on each object and wherein said readers are RFID readers, one of said RFID chips being a short range transmission chip for transmitting its stored code to said reader associated with said storage unit and the other one of said RFID chips being a long range transmission chip for transmitting its stored code to said external reader.

24. The system of claim 20 and an area surrounding said system is divided into zones and further comprising additional readers at transitions between zones, said additional readers being coupled to said controller for communicating to said controller identification codes of objects transitioning between zones and said controller being programmed to track the movement of objects from zone to zone based upon the identification codes communicated by said additional readers.

* * * * *